US010591849B2

(12) United States Patent
Tatezawa

(10) Patent No.: US 10,591,849 B2
(45) Date of Patent: Mar. 17, 2020

(54) IMAGE FORMING APPARATUS

(71) Applicant: CANON KABUSHIKI KAISHA, Tokyo (JP)

(72) Inventor: Hidekazu Tatezawa, Soka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/523,581

(22) Filed: Jul. 26, 2019

(65) Prior Publication Data

US 2020/0041937 A1 Feb. 6, 2020

(30) Foreign Application Priority Data

Aug. 1, 2018 (JP) ..... 2018-145438

(51) Int. Cl.

| | |
|---|---|
| ***G03G 15/16*** | (2006.01) |
| ***G03G 15/00*** | (2006.01) |
| ***G03G 15/20*** | (2006.01) |

(52) U.S. Cl.

CPC ..... *G03G 15/1605* (2013.01); *G03G 15/2053* (2013.01); *G03G 15/5012* (2013.01); *G03G 15/70* (2013.01)

(58) Field of Classification Search

CPC ..... G03G 15/1605; G03G 15/5012; G03G 15/2053; G03G 15/70

See application file for complete search history.

(56) References Cited

FOREIGN PATENT DOCUMENTS

| | | | |
|---|---|---|---|
| JP | 2011197113 A | * | 10/2011 |
| JP | 2015-028659 A | | 2/2015 |
| JP | 2017032951 A | * | 2/2017 |

* cited by examiner

*Primary Examiner* — Susan S Lee

(74) *Attorney, Agent, or Firm* — Venable LLP

(57) ABSTRACT

An image forming apparatus includes a motor, a unit including first and second rotatable members, an input gear, a first transmission path, a second transmission path, a rotation detecting portion, and a controller. The a controller executes an operation in an abnormality output mode for outputting abnormality information, wherein if the first rotatable member is not rotated despite rotation of the motor in a first direction, the controller inputs a signal for rotating the motor in a second direction, and (1) if the second rotatable member is not rotated, the controller outputs abnormality information regarding the motor or a drive transmission path for transmitting the driving force from the motor to the input gear, and (2) if the second rotatable member is rotated, the controller outputs abnormality information regarding the unit.

7 Claims, 13 Drawing Sheets

(a)

(b)

(a)

(b)

(a)

(b)

(a)

(b)

IMAGE FORMING APPARATUS

FIELD OF THE INVENTION AND RELATED ART

The present invention relates to an image forming apparatus, such as a multi-function machine, a copying machine, a printer or a facsimile machine, for forming an image on a recording material using an electrophotographic method.

Conventionally, in an image forming apparatus of an electrophotographic type, an electrostatic latent image formed on a photosensitive drum as an image bearing member is developed with toner by a developing device, and thus a toner image is formed. Then, the toner image is transferred onto a sheet and then is fixed on the sheet at a fixing portion by being heated and pressed. The fixing portion includes, for example, a rotatable heating member for heating an unfixed toner image transferred and carried on the sheet, a rotatable pressing member for forming a nip in press-contact with the rotatable heating member, and a driving motor for rotationally driving the rotatable pressing member. The fixing portion is constituted in many cases by being roughly divided into a fixing unit for feeding and heating the sheet and a driving unit for transmitting a driving force to the fixing unit. This is because a durability lifetime of the fixing unit is set so as to be shorter than a durability lifetime of a main assembly of the image forming apparatus in many instances, and it is assumed that the fixing unit is exchanged plural times before the durability lifetime of the main assembly reaches its end. For this reason, it is advantageous in terms of cost that a driving unit including the driving motor is provided in the main assembly of the image forming apparatus so that a driving unit including the driving motor, which is expensive, is not exchanged with an exchange of the fixing unit.

In the case where some abnormality occurs in such a fixing portion, there is a need that a service person proceeds to a place where the abnormality occurs and discriminates whether the site of a malfunction is the fixing unit or the driving unit and then provides a service part corresponding to the site of the malfunction. Here, for example, if only an error notifying abnormality of a fixing portion driving system during an occurrence of the abnormality is displayed, the service person cannot discriminate which one of the fixing unit and the driving unit caused the malfunction. For that reason, in some cases, the service person proceeded to the place where the abnormality occurred and predicted or identified the site of the malfunction, and then returned to a service depot. Thereafter, the service person having acquired the service part returned again to the place where the abnormality occurred and then handled replacement of service part in some cases. When such an operation is performed, not only does it take time and cost to perform movement and a discrimination operation of the service person, but also downtime occurs since the image forming apparatus cannot be used until the handling of the service part is ended, so that there was a liability that productivity of a user is lowered.

In order to solve this problem, an image forming apparatus capable of identifying the site of a malfunction when a drive malfunction is detected has been proposed (Japanese Laid-Open Patent Application (JP-A) 2015-28659). According to this image forming apparatus, it is possible to not only discriminate occurrence or non-occurrence of a malfunction of a driving motor on the basis of a difference in frequency of an input output signal of the driving motor but also discriminate occurrence or non-occurrence of abnormality of a heating roller or a pressing roller on the basis of a detection result of rotation of the heating roller or the pressing roller.

However, in the image forming apparatus of JP-A 2015-28659, for example, in the case where the driving motor is stopped contrary to an instruction, discrimination whether the driving motor itself is stopped due to a malfunction thereof or the driving motor is stopped due to that a gear or the life of a driving system caused a malfunction and thus cannot be rotated, cannot be made. Or, in the case where discrimination that abnormality of the heating roller or the pressing roller occurs is made, discrimination that abnormality occurred at which site of the driving system from the driving motor which operates normally to the heating roller or the pressing roller cannot be made. That is, in either case, a position where the abnormality occurred cannot be identified, so that discrimination that the site of the malfunction is either one of the fixing unit and the driving unit is not made, and therefore, it is difficult to reduce a movement time and an operation time of the service person and downtime of the user. Further, even at a portion other than the fixing portion, a similar problem can arise in a mechanism including the driving motor provided in the main assembly of the image forming apparatus and including a rotatable member which is provided in a unit mountable to and dismountable from the main assembly of the image forming apparatus and which is driven by the driving motor.

SUMMARY OF THE INVENTION

A principal object of the present invention is to provide an image forming apparatus capable of discriminating whether an error occurs in a motor or a driving system.

According to an aspect of the present invention, there is provided an image forming apparatus for forming a toner image on a recording material, comprising a motor provided in the image forming apparatus and rotatable in a first direction and a second direction opposite to the first direction; a unit which includes a first rotatable member and a second rotatable member and which is mountable to and dismountable from a main assembly of the image forming apparatus; an input gear provided in the unit and configured to permit input of a driving force of the motor from the image forming apparatus; a first transmission path provided in the unit, wherein when the motor rotates in the first direction, the driving force is transmitted from the input gear to the first rotatable member and is not transmitted from the input gear to the second rotatable member; a second transmission path provided in the unit, wherein when the motor rotates in the second direction, the driving force is transmitted from the input gear to the second rotatable member and is not transmitted from the input gear to the first rotatable member; a rotation detecting portion capable of detecting rotation of the second rotatable member; and a controller configured to execute an operation in an abnormality output mode for outputting abnormality information, wherein if the first rotatable member is not rotated despite rotation of the motor in the first direction, the controller inputs a signal for rotating the motor in the second direction, and (1) if the second rotatable member is not rotated, the controller outputs abnormality information on the motor or a drive transmission path for transmitting the driving force from the motor to the input gear, and (2) if the second rotatable member is rotated, the controller outputs abnormality information on the unit.

Further features of the present invention will become apparent from the following description of exemplary embodiments with reference to the attached drawings.

Figure 5:
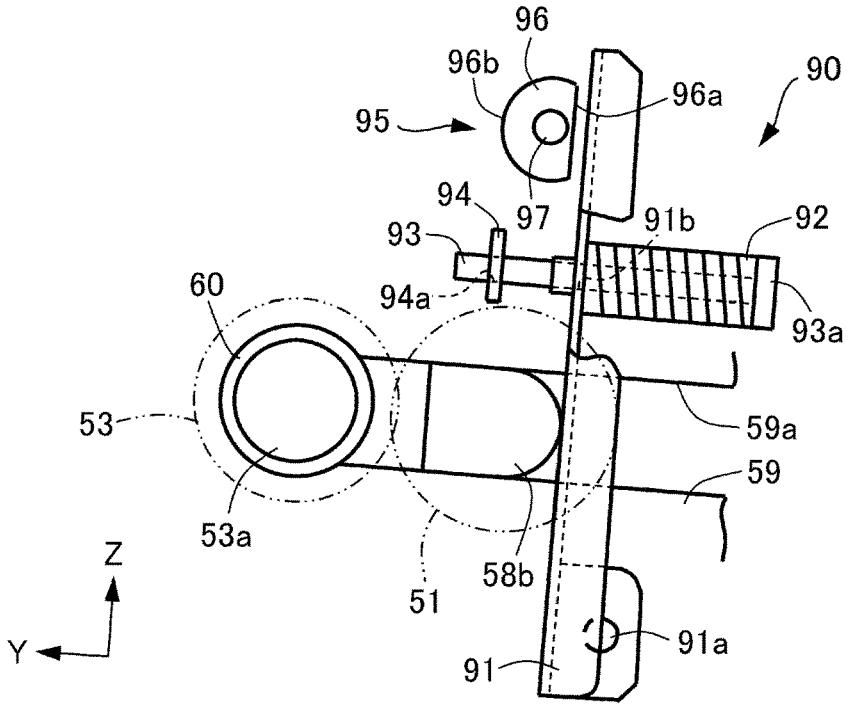
Figure 5:
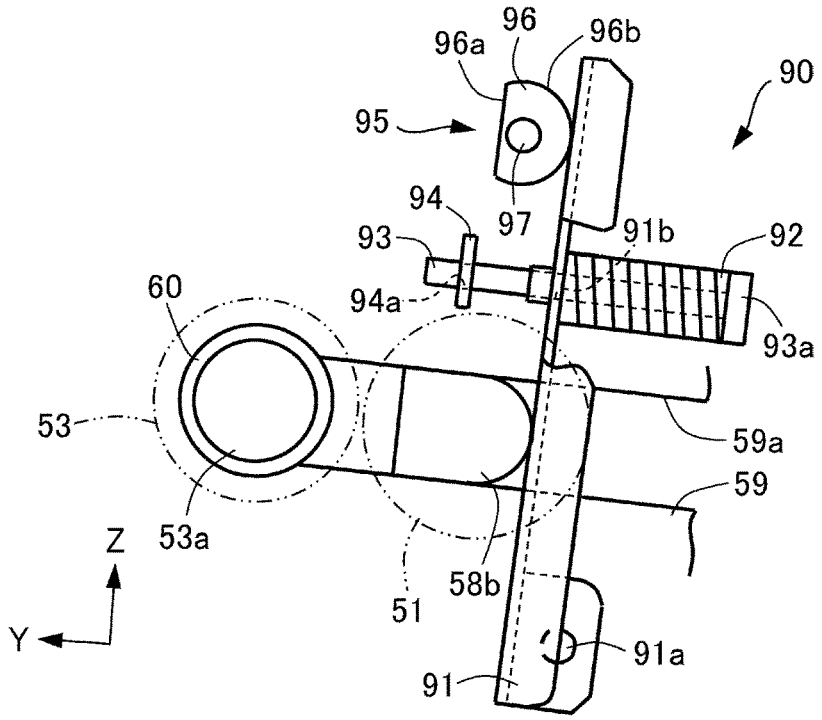

Parts (a) and (b) of FIG. 5 are side views showing schematic structure of a contact and separation mechanism for the fixing device according to the embodiment, wherein part (a) shows a pressed state, and part (b) shows a pressure-released state.

Figure 6:
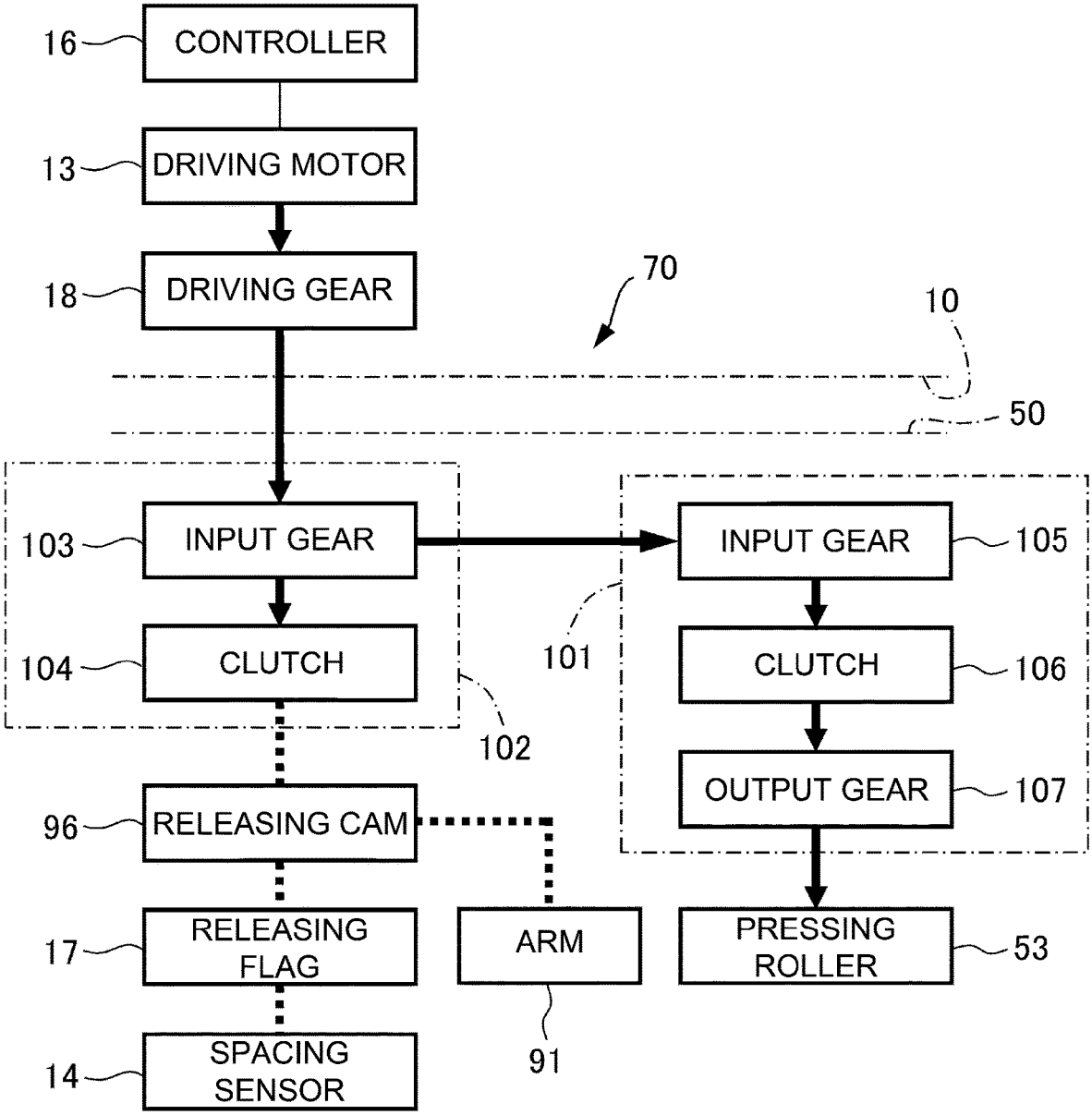

FIG. 6 is a block diagram showing a drive transmission path during normal rotation of a drive transmission mechanism for the fixing device according to the embodiment.

Figure 7:
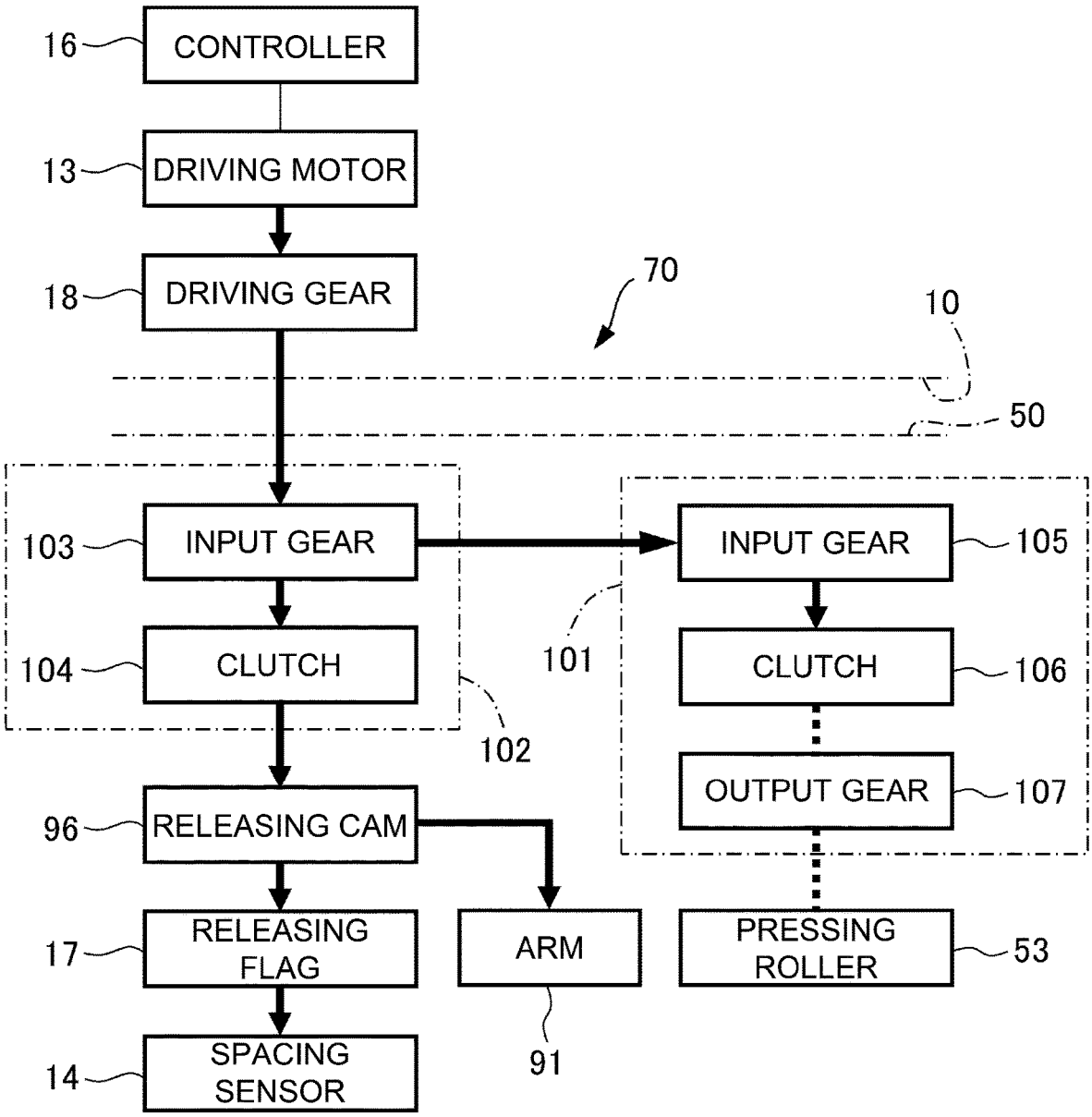

FIG. 7 is a block diagram showing a drive transmission path during reverse rotation of the drive transmission mechanism for the fixing device according to the embodiment.

Figure 8:
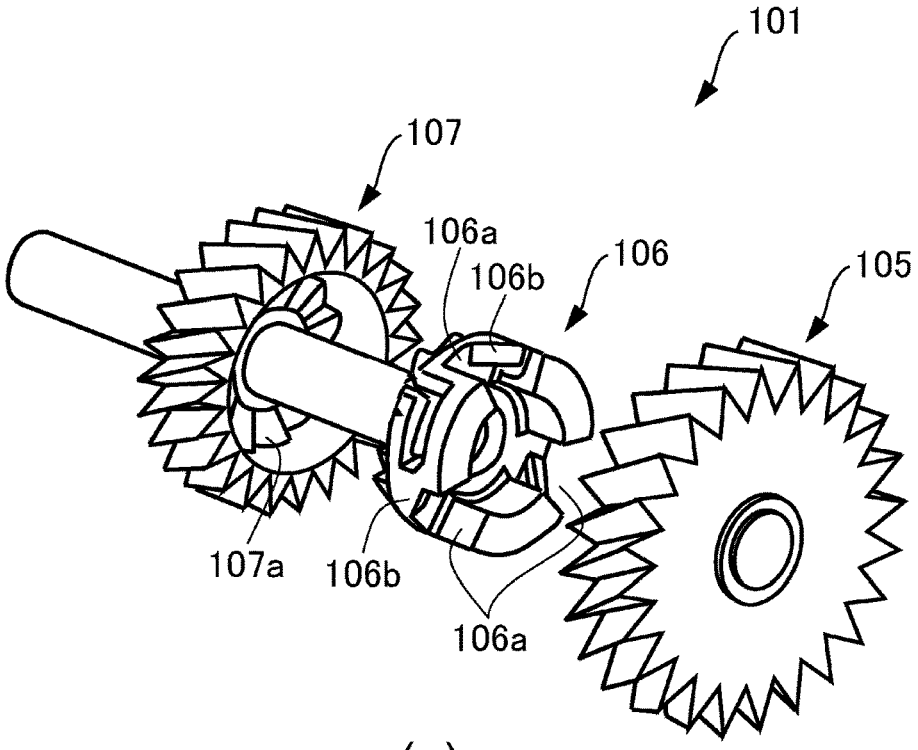
Figure 8:
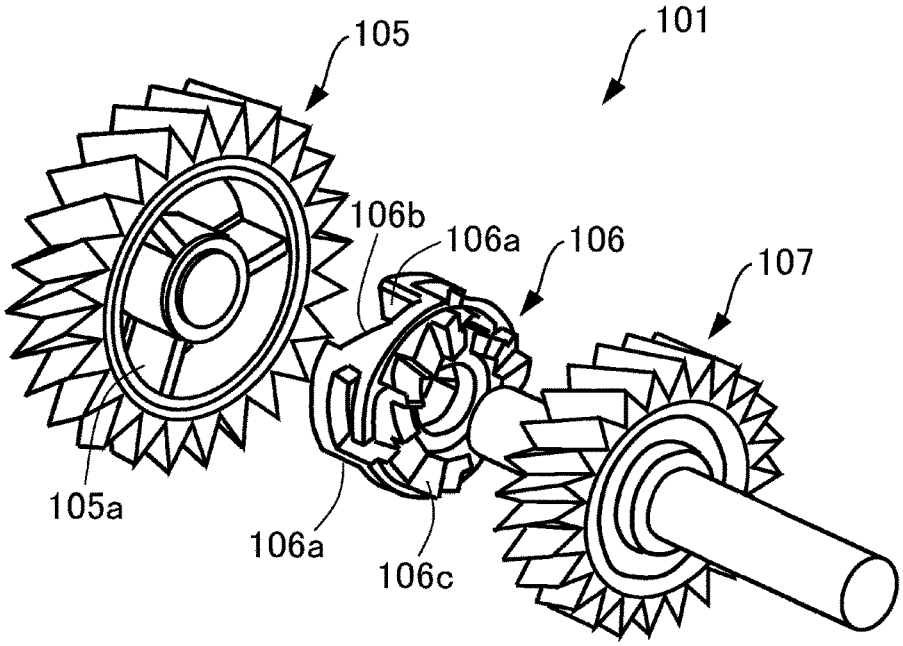

Parts (a) and (b) of FIG. 8 show a clutch unit of the drive transmission mechanism for the fixing device according to the embodiment, wherein part (a) is a perspective view as seen from an upstream side of a drive train, and part (b) is a perspective view as seen from a downstream side of the drive train.

Figure 9:
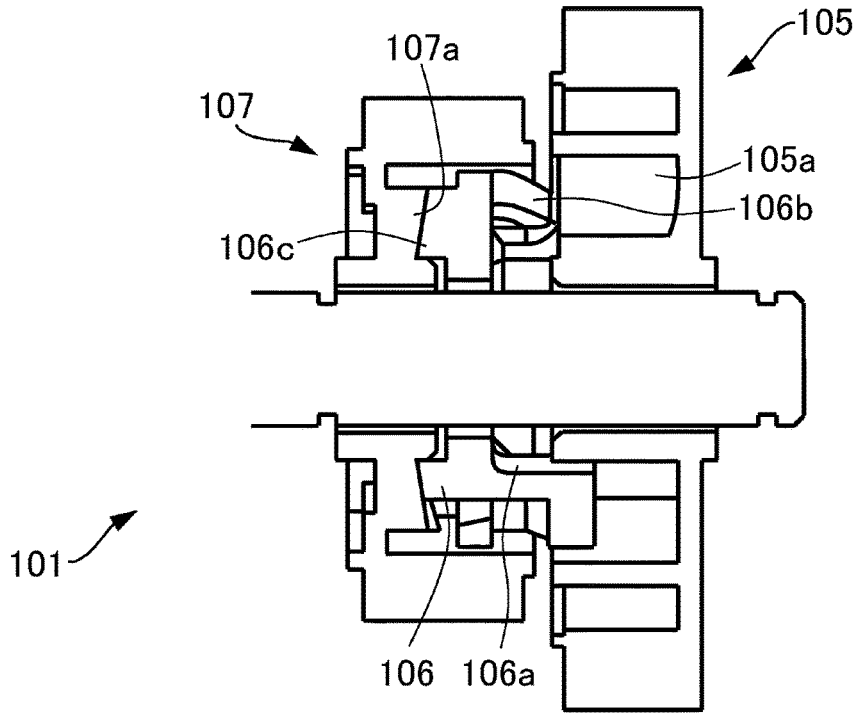
Figure 9:
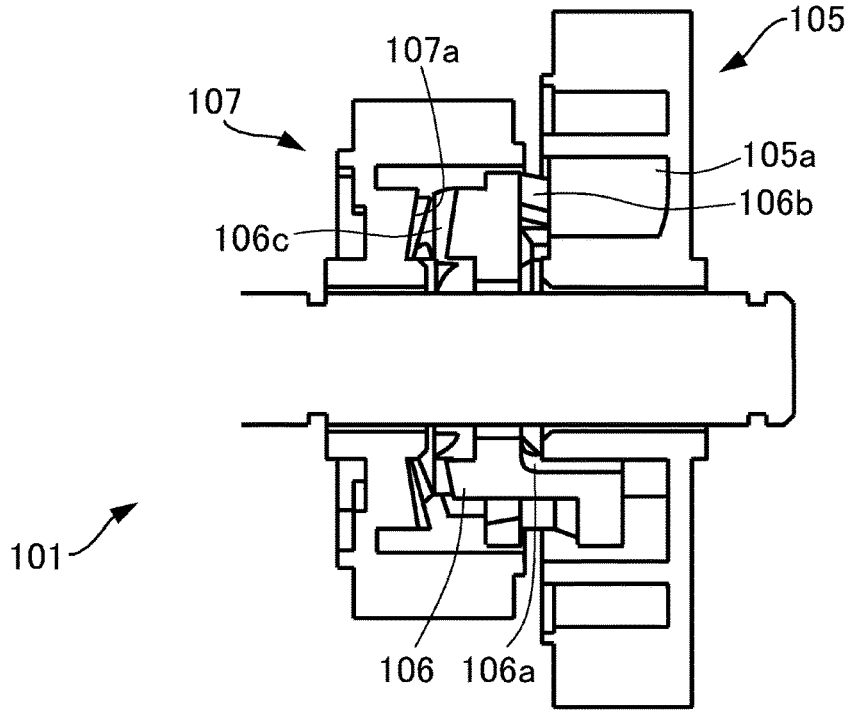

Parts (a) and (b) of FIG. 9 show the clutch unit of the drive transmission mechanism for the fixing device according to the embodiment, wherein part (a) is a sectional view during normal rotation, and, part (b) is a sectional view during reverse rotation.

Figure 10:
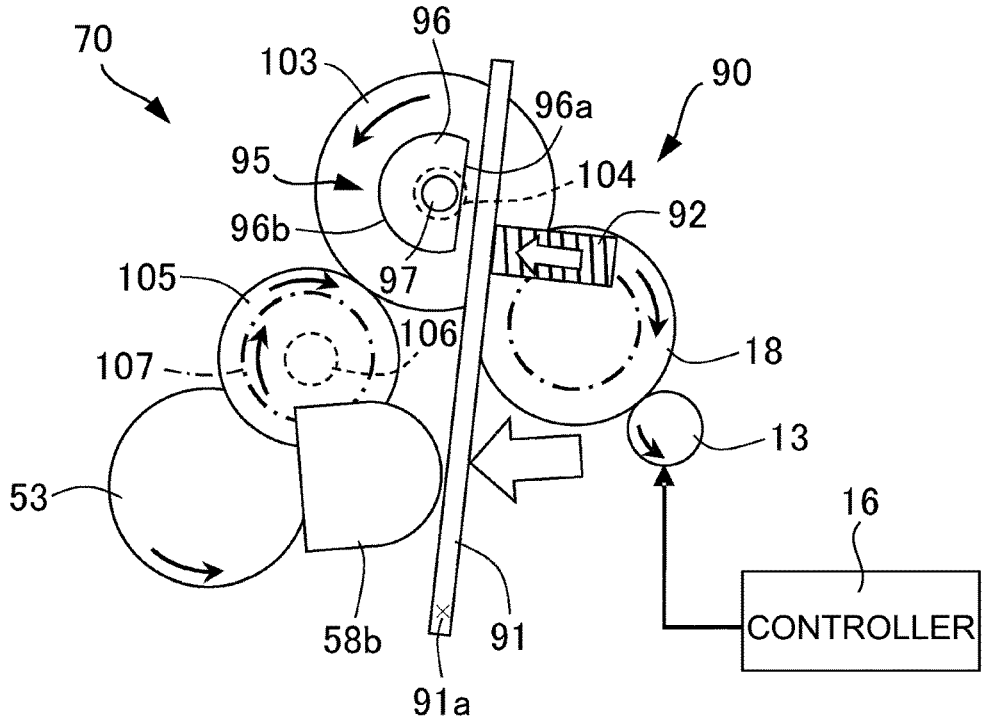
Figure 10:
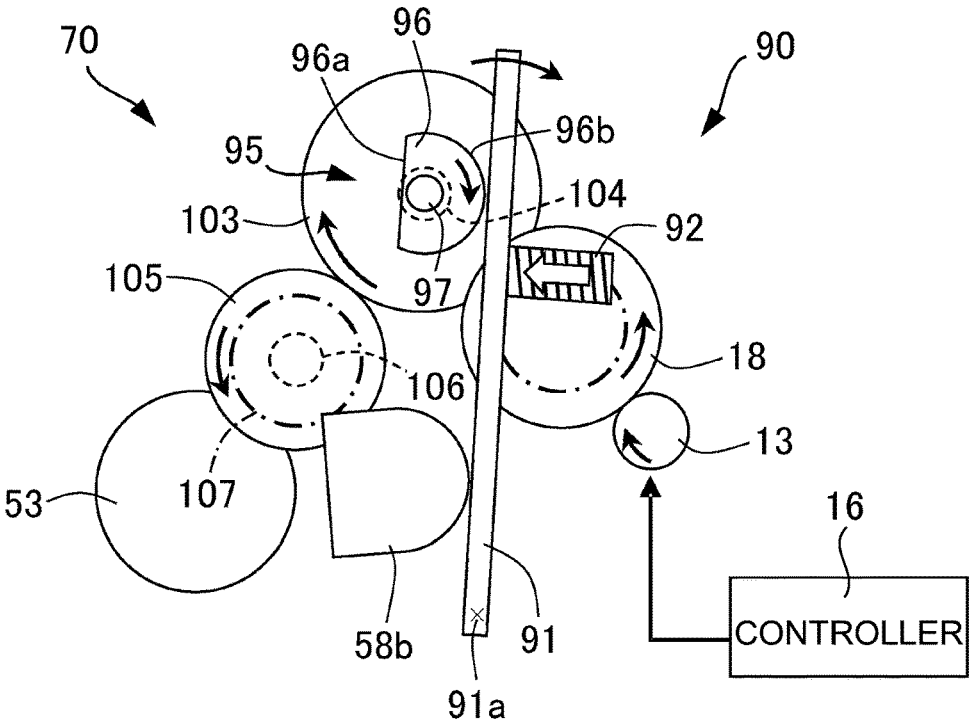

Parts (a) and (b) of FIG. 10 are side views showing the drive transmission mechanism for the fixing device according to the embodiment, wherein part (a) shows the drive transmission mechanism during the normal rotation, and part (b) shows the drive transmission mechanism during the reverse rotation.

Figure 11:
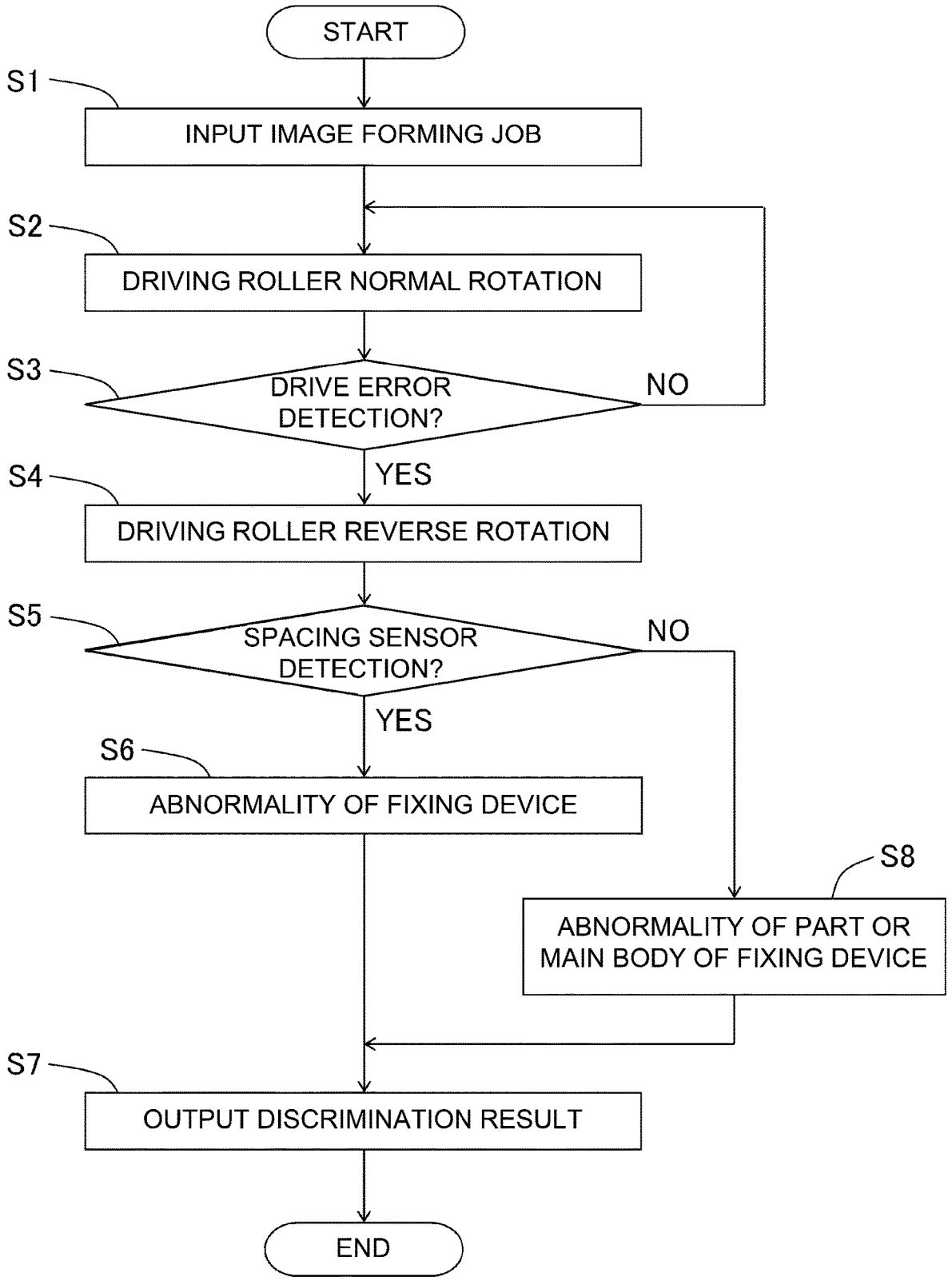

FIG. 11 is a flowchart showing a process procedure during a drive error of the image forming apparatus according to the embodiment.

Figure 12:
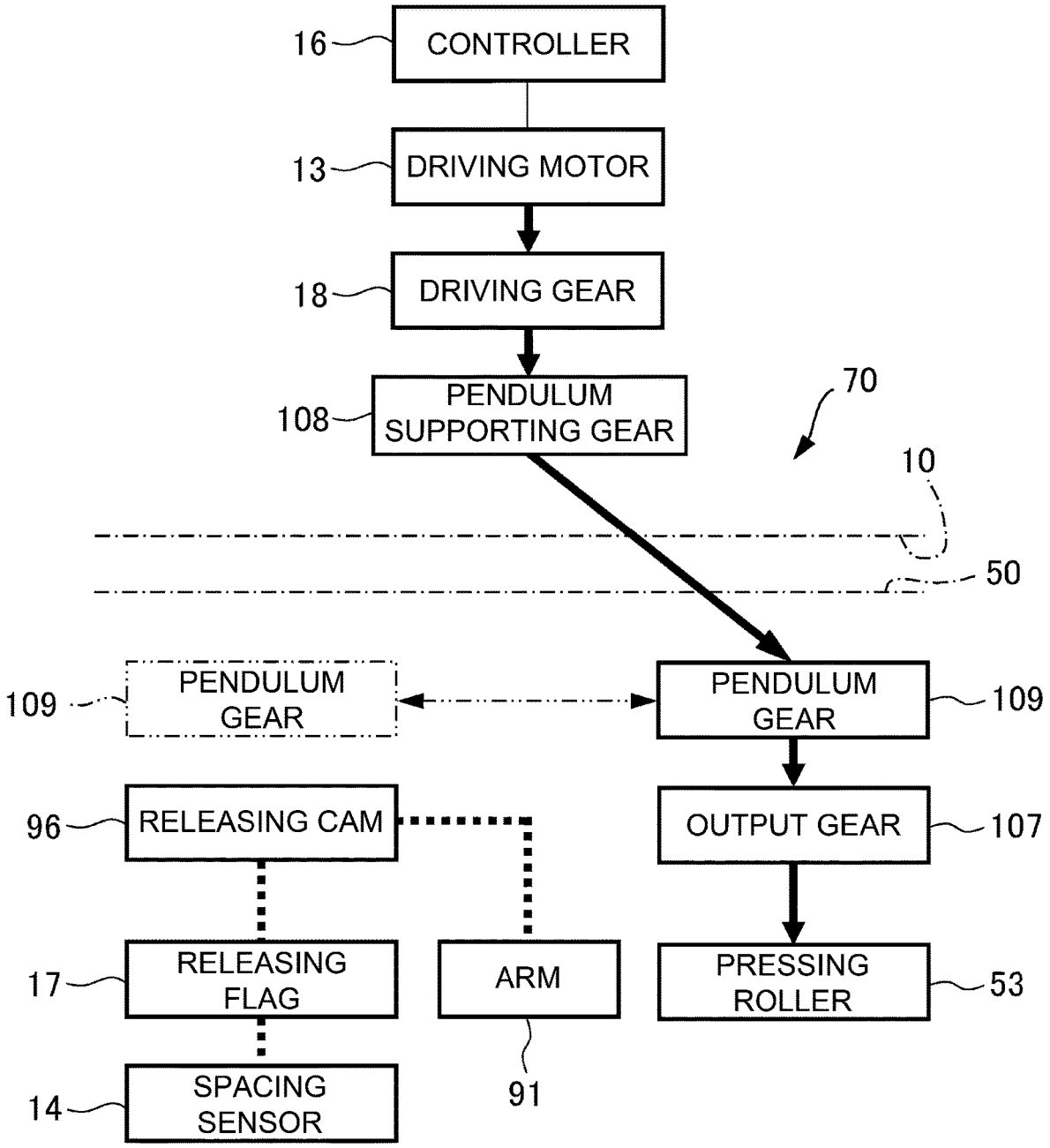

FIG. 12 is a schematic view showing a drive transmission path during normal rotation of a drive transmission mechanism in a modified example of the fixing device according to the embodiment.

Figure 13:
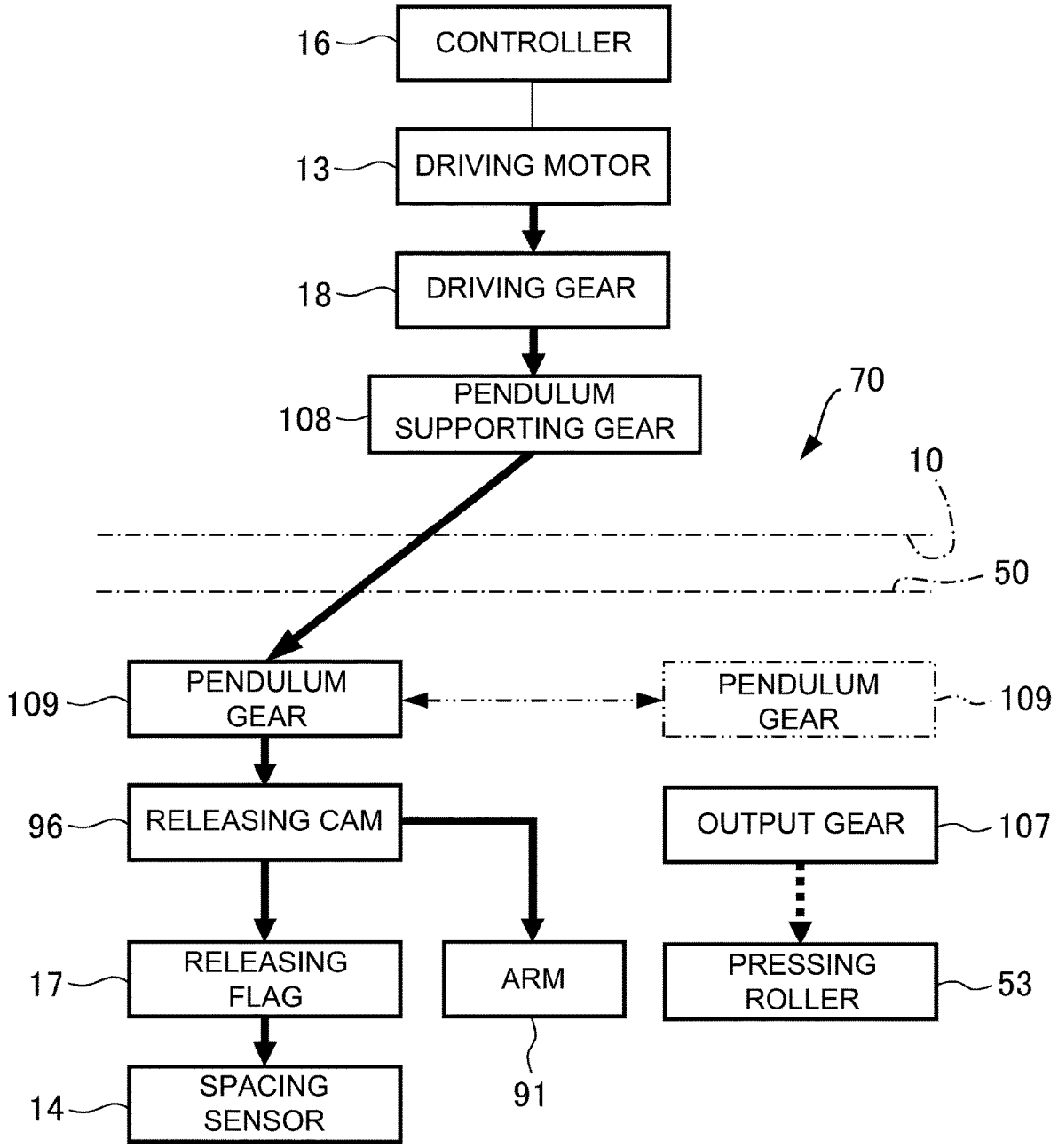

FIG. 13 is a schematic view showing a drive transmission path during reverse rotation of the drive transmission mechanism in the modified example of the fixing device according to the embodiment.

EMBODIMENTS FOR CARRYING OUT THE INVENTION

In the following, a developing device in an embodiment of the present invention will be specifically described with reference to FIGS. 1 to 11. In this embodiment, as an example of an image forming apparatus 1, a full-color printer of a tandem type is described. However, the present invention is not limited to the image forming apparatus 1 of the tandem type but may also be an image forming apparatus of another type. Further, the image forming apparatus is not limited to the full-color image forming apparatus (printer), but may also be a monochromatic or a mono-color (single color) image forming apparatus (printer).

[Image Forming Apparatus]

Figure 1:
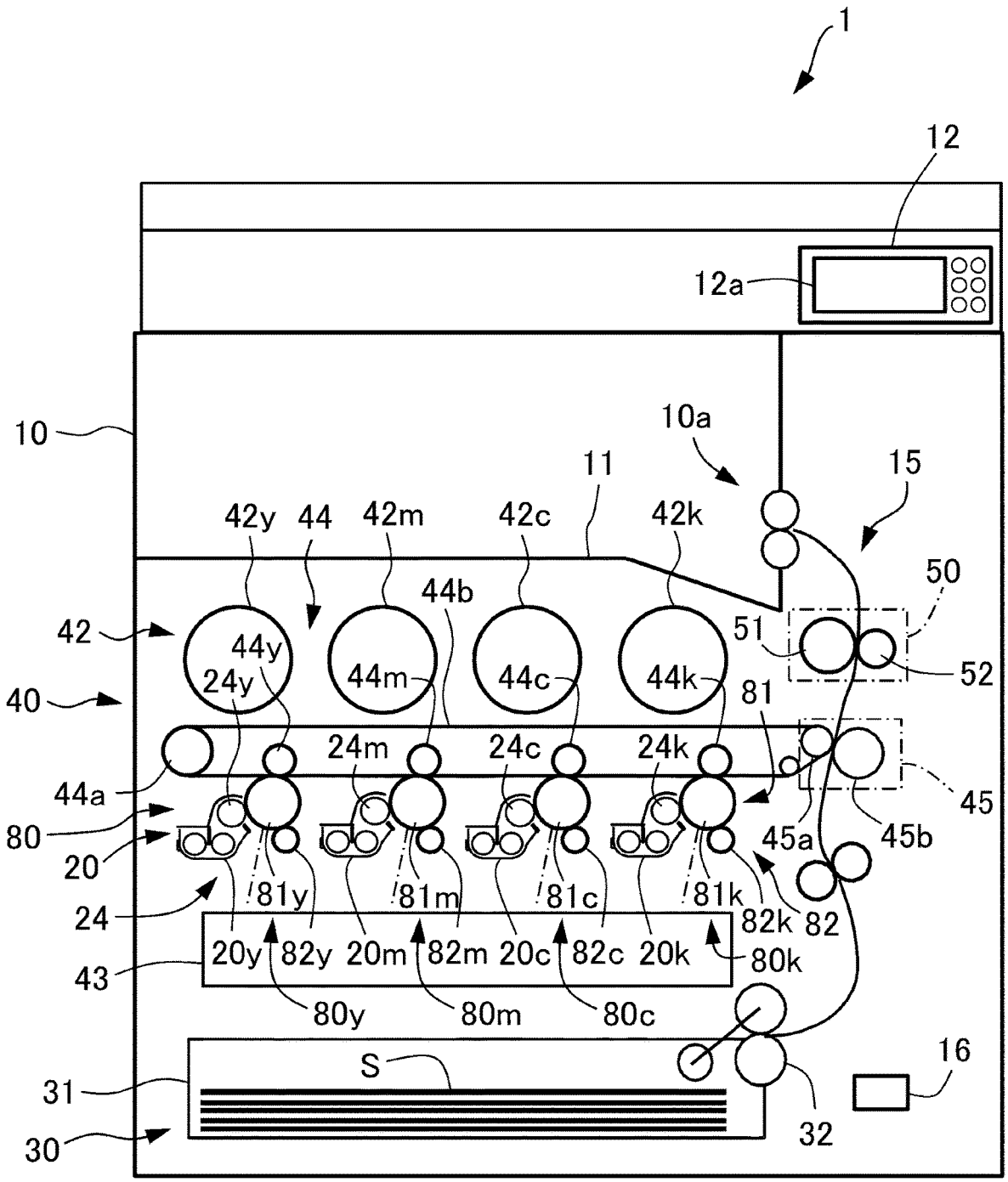
FIG. 1 is a sectional view showing a schematic structure of an image forming apparatus according to an embodiment.

As shown in FIG. 1, the image forming apparatus 1 includes an image forming apparatus main assembly (hereinafter, referred to as an apparatus main assembly) 10. The apparatus main assembly 10 includes a sheet feeding portion 30, an image forming portion 40, a sheet conveying portion 15, a sheet discharging portion 11, a controller 16, and an operating portion 12. On a sheet S as a recording material, a toner image is to be formed, and specific examples of the sheet S may include plain paper, a resin (material) sheet as a substitute for the plain paper, thick paper, a sheet for an overhead projector, and the like.

The sheet feeding portion 30 is disposed at a lower portion of the apparatus main assembly 10, and includes a sheet cassette 31 for stacking and accommodating the sheets S and includes a feeding roller 32, and feeds the accommodated sheet S to the image forming portion 40.

The image forming portion 40 includes image forming units 80, an unshown toner hopper, toner containers 42, a laser scanner 43, an intermediary transfer unit, a secondary transfer portion 45 and a fixing device (unit) 50. The image forming portion 40 is capable of forming an image on the sheet S on the basis of image information. Incidentally, the image forming apparatus 1 of this embodiment meets full-color image formation, and the image forming units 80*y*, 80*m*, 80*c*, 80*k* have similar constitutions for four colors of yellow (y), magenta (m), cyan (c), black (k), respectively, and are separately provided. Also the toner containers 42*y*, 42*m*, 42*c*, 42*k* similarly have the same constitution for the four colors of yellow (y), magenta (m), cyan (c), black (k), respectively, and are separately provided. For this reason, in FIG. 1, respective constituent elements for the four colors are represented by identifiers for the colors, but in the specification, are described using only reference numerals or symbols without adding the identifiers for the colors in some cases.

The toner containers 42 are, for example, cylindrical bottles, and the toners are accommodated, and above the respective image forming unit 80, the toner container 42 is connected and disposed through the unshown hopper. The laser scanner 43 exposes the surface of the photosensitive drum 81, electrically charged by the charging roller 82, to light and thus an electrostatic latent image is formed on the surface of the photosensitive drum 81.

The image forming unit 80 includes the four image forming units 80*y*, 80*m*, 80*c*, 80*k* for forming toner images of the four colors. Each image forming unit 80 includes the photosensitive drum 81 for forming the toner image, a charging roller 82, a developing device 20 and an unshown cleaning blade. Further, the photosensitive drum 81, the charging roller 82, the developing device 20, and a developing sleeve 24 (described later) have the same constitution for the four colors of yellow (y), magenta (m), cyan (c), black (k), respectively, and are separately provided.

The photosensitive drum 81 includes a photosensitive layer formed on an outer peripheral surface of an aluminum cylinder of, for example, 30 mm in diameter so as to have a negative charge polarity, and is rotated in an arrow direction at a predetermined process speed (peripheral speed). The charging roller 82 contacts the surface of the photosensitive drum 81 and electrically charges the surface of the photosensitive drum 81 to, e.g., a uniform negative dark-portion potential. After the charging, at each of the respective surfaces of the photosensitive drums 81, an electrostatic image is formed on the basis of image information by the laser scanner 43. Each of the photosensitive drums 81 carries the formed electrostatic image and is circulated and moved, and the electrostatic image is developed with the toner by the developing device 20. The developing device 20 is mountable to and dismountable from the apparatus main assembly 10 and includes a developing sleeve 24, and develops the electrostatic image formed on the photosensitive drum 81.

The toner image obtained by developing the electrostatic image is primary-transferred onto an intermediary transfer belt 44*b* described later. The surface of the photosensitive drum 81 after the primary transfer is discharged by an unshown pre-exposure portion.

The intermediary transfer unit 44 is disposed above the image forming units 80*y*, 80*m*, 80*c* and 80*k*. The intermediary transfer unit 44 includes a driving roller 44*a*, a plurality of primary transfer rollers 44*y*, 44*m*, 44*c* and 44*k*, and the intermediary transfer belt 44*b* wound around these rollers. The primary transfer rollers 44*y*, 44*m*, 44*c* and 44*k* are disposed opposed to the photosensitive drums 81, 81*m*, 81*c* and 81*k*, respectively, and are disposed in contact with the intermediary transfer belt 44*b*.

A positive-polarity transfer bias is applied to the intermediary transfer belt 44*b* through the primary transfer rollers 44*y*, 44*m*, 44*c* and 44*k*, whereby toner images having the negative polarity are superposedly transferred successively from the photosensitive drums 81*y*, 81*m*, 81*c* and 81*k* onto the intermediary transfer belt 44*b*. By this, the toner images obtained by developing the electrostatic images on the surfaces of the photosensitive drums 81*y*, 81*m*, 81*c* and 81*k* are transferred on the intermediary transfer 44*b*, and the intermediary transfer belt 44*b* moves.

The secondary transfer portion 45 includes a secondary transfer inner roller 45*a* and a secondary transfer outer roller 45*b*. By applying a positive-polarity secondary transfer bias to the secondary transfer outer roller 45*b*, the full-color image formed on the intermediary transfer belt 44*b* is transferred onto the sheet S. The fixing device 50 has a cartridge shape and is provided so as to be mountable to and dismountable from the apparatus main assembly 10. The fixing device 50 heats and presses the toner image transferred on the sheet S and thus fixes the toner image on the sheet S. The fixing device 50 is driven by a driving motor (driving source) 13 (FIGS. 4 and 6) provided in the apparatus main assembly 10.

The sheet conveying portion 15 feeds the sheet S, fed from the sheet feeding portion 30, from the image forming portion 40 to the sheet discharge portion 11. The sheet discharge portion 11 is a face-down tray, and the sheet S discharged through a discharge opening 10*a* is stacked on the sheet discharge portion 11.

Figure 2:
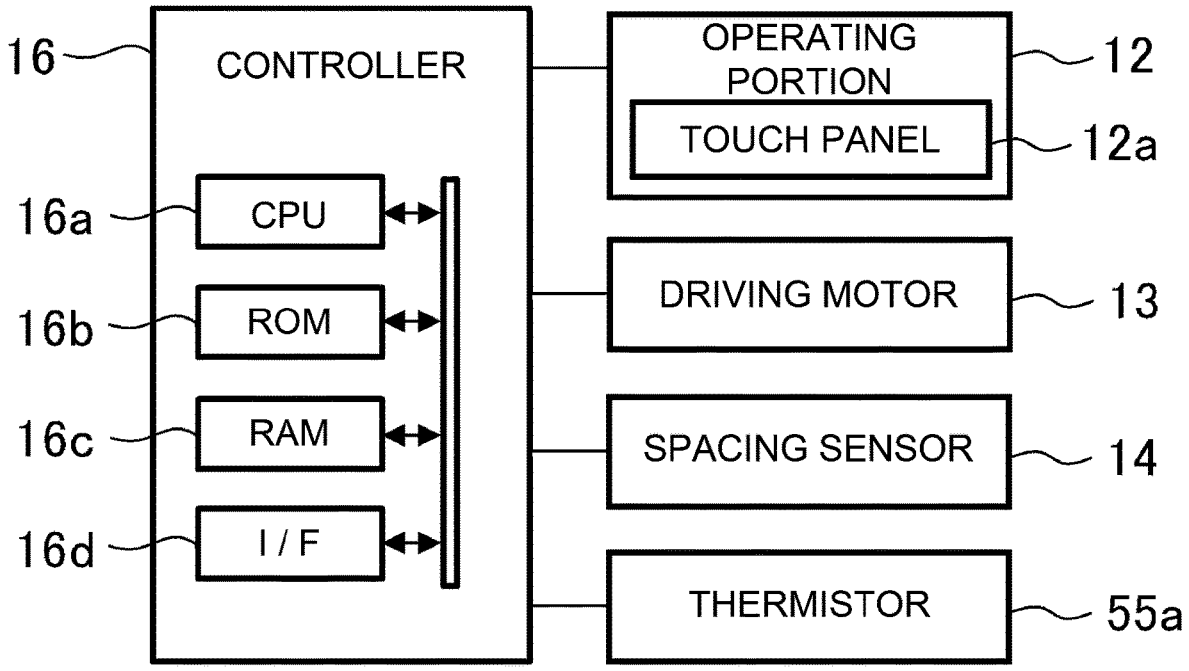
FIG. 2 is a control block diagram of the image forming apparatus according to the embodiment.

As shown in FIG. 2, a controller 16 is constituted by a computer and, e.g., includes a CPU 16*a*, a ROM 16*b* for storing a program for controlling respective portions, a RAM 16*c* for temporarily storing data, and an input-and-output circuit (I/F) 16*d* for inputting and outputting signals relative to an external device. The CPU 16*a* is a microprocessor for effecting entire control of the image forming apparatus 1 and is a principal part of a system controller. The CPU 16*a* is connected via the input-and-output circuit (I/F) 16*d* with each of the sheet feeding portion 30, the image forming portion 40, the sheet conveying portion 15, and an operating portion 12, and transfers signals with the respective portions and controls operations of the respective portions. To the controller 16, the driving motor 13 for the fixing device 50 is connected, so that the controller 16 is capable of controlling an operation of the fixing device 50. To the controller 16, the operating portion 12 is connected, and the operating portion 12 includes a touch panel (output means) 12*a* of, for example, a liquid crystal and is provided so as to permit input of information from an outside to the CPU 16*a* through input of data by operation of the touch panel 12*a* by the user. The touch panel 12*a* functions as output means capable of outputting information. Further, to the controller 16, the driving motor 13 capable of normal rotation and reverse rotation, a spacing sensor 14 capable of detecting a pressure-releasing flag 17 (described later), and a thermistor 55*a* capable of detecting a temperature of a heater 55 (described later) are connected. The driving motor 13 is provided in the apparatus main assembly 10 and is capable of rotationally driving the input gear 103 (FIG. 6) (described later) in a normal rotation direction (first direction) and a reverse rotation direction (second direction) opposite to the normal rotation direction. That is, the controller 16 controls a rotational direction of the driving motor 13. To the controller 16, an unshown external personal computer is connected through an unshown LAN cable (communication line). Image data for forming the image is inputted from the connected external personal computer to the CPU 16*a* of the image forming apparatus 1 through the LAN cable. On the basis of the inputted image data, the CPU 16*a* causes the image forming portion 40 to form the toner image corresponding to the inputted image data. Incidentally, a constitution in which a scanner for reading an original is provided on the image forming apparatus 1 and in which the CPU 16*a* causes the image forming portion 40 to form the toner image corresponding to image data read by the scanner may also be employed.

Next, an image forming operation in the image forming apparatus 1 constituted as described above will be described. When the image forming operation is started, first, the photosensitive drum 81 is rotated, and the surface thereof is electrically charged by the charging roller 82. Then, the laser scanner 43 emits, on the basis of image information, laser light toward the surface of the photosensitive drum 81, so that the electrostatic latent image is formed on the surface of the photosensitive drum 81. The toner is deposited on the electrostatic latent image, so that the electrostatic latent image is developed (visualized) into a toner image, and then the toner image is transferred onto the intermediary transfer belt 44*b*.

On the other hand, in parallel to such a toner image forming operation, the feeding roller 32 is rotated and feeds an uppermost sheet S of sheets S accommodated in the sheet cassette 31 while separating the sheet S. Then, each of the sheets S is fed to a secondary transfer portion 45 by being timed to the toner image on the intermediary transfer belt 44*b*. Then, the toner image is transferred from the intermediary transfer belt 44*b* onto the sheet S, and the sheet S is fed into the fixing device 50, in which the unfixed toner image is heated and pressed, and thus is fixed on the surface of the sheet S. The sheet S is discharged through the discharge opening 10*a* and is stacked on the sheet discharge portion 11.

[Fixing Device]

Next, the developing device 50 will be specifically described with reference to FIGS. 3 and 4. In this embodiment, the fixing device 50 is an image heating device of a film (belt) heating type and a rotatable pressing member drive type (tensionless type). The fixing device 50 includes a heating unit 52 including a cylindrical fixing film (third rotatable member) 51 as the rotatable heating member, a pressing roller 53 as a first rotatable member, and a (fixing) device frame 54 with which these members are assembled. Incidentally, in this embodiment, in the fixing device 50, a sheet feeding direction in the nip is Z direction, a sheet widthwise direction perpendicular to the Z direction is X direction, and a contact and separation direction perpendicular to the Z direction and the X direction is Y direction.

The heating unit 52 is an assembly including the fixing film 51, a heater 55 as a heating member for heating the fixing film 51, a guide 56, a stay 57, flange members 58 provided opposed to the fixing film 51 at each of opposite end portions of the fixing film 51, and like members. A nip (fixing nip) N is formed by press-contact between the fixing film 51 and the pressing roller 53 which are used as a pair of rotatable members. That is, the fixing film 51 forms the nip N, where the image is formed on the sheet (recording material) S by the image forming portion 40, in cooperation with the pressing roller 53. The nip N is a portion where the sheet S, on which an unfixed toner image ta introduced from the image forming portion 40 side is carried, is nipped and conveyed and then the unfixed toner image ta is fixed as a fixed image under application of heat and pressure. The fixing film 51 rotates while contacting the sheet S carrying the unfixed toner image ta.

[Fixing Film]

The fixing film 51 is a thin heat-resistant member which principally includes, for example, a base layer comprising a cylindrical (endless belt-shaped, sleeve-shaped) heat-resistant film or metal, an elastic layer laminated on an outer peripheral surface side of the base layer, and a parting layer laminated on an outer peripheral surface side of the elastic layer and which has flexibility as a whole. The fixing film 51 has a substantially cylindrical shape by elasticity thereof in a free state.

[Heater]

In this embodiment, as the heater 55 which is a heat source, an elongated thin plate-shaped ceramic heater (plate-like heat generating member) which abruptly increases in temperature by energization and which has predetermined heat capacity is used. The heater 55 has a basic structure including an elongated thin plate-shaped heater substrate made of ceramic, such as alumina or aluminum nitride, having a good heat-conducting property and a good electrical insulation property, and including a heat generation resistance layer which is formed along a longitudinal direction of a surface of the substrate and which principally contains AgPd alloy, NiSn alloy, $RuO_2$ or the like.

[Film Guide Member]

The guide 56 which is a film guided member is provided along the X direction which is the longitudinal direction (sheet widthwise direction) of the fixing film 51 and has a heat-resistant property and rigidity. In this embodiment, the guide 56 has a substantially semicircular trough shape in cross-section and is a molded product made of a liquid crystal polymer (resin). The heater 55 is engaged in and held by a groove portion (bearing surface) 56*a* formed on another peripheral surface of the guide 56 along the X direction. As a result, the guide 56 not only holds the heater 55 by the groove portion 56*a* but also guides rotation of the fixing film 51 by the outer peripheral surface thereof

[Reinforcing Stay]

The stay 57 is a reinforcing stay and is an elongated rigid member extending along the X direction of the fixing film 51. The stay 57 may desirably be formed of a material which is not readily flexed even when high pressure is exerted thereon. In this embodiment, as the stay 57, a molded member of SUS 304 having a U-shape in cross-section, i.e., a channel shape in cross-section, may be used. The stay 57 is provided on a side opposite from the heater 55 and supports the guide 56 while reinforcing the guide 56. The stay 57, the guide 56 and the heater 55 are integrally assembled as an assembly, and opposite end portions thereof are held by the flange members 58.

[Flange Member]

The fixing film 51 is externally engaged (fitted) loosely around the assembly of the heater 55, the guide 56 and the stay 57. The opposite end portions of the guide 56 and the stay 57 with respect to the X direction project outwardly from the opposite end portions of the fixing film 51, respectively, and are held by the flange members 58, respectively. The flange members 58 are disposed on one side (rear side: driving side) and the other side (front side: non-driving side) of the fixing film 51. The respective flange members 58 are engaged with the stay 57 at the opposite end portions so as to sandwich the fixing film 51 from the X direction. The flange members 58 include rotation guide portions 58*a* provided so as to project toward the fixing film 51 side. The opposite end portions of the fixing film 51 are rotatably held by the rotation guide portions 58*a*, respectively. As a result, the flange members 58 not only guide rotation of the fixing film 51, but also prevent a slip-out of the fixing film 51 in an axial direction. Further, the respective flange members 58 include portions-to-be-urged 58*b*, respectively.

[Pressing Roller]

The pressing roller 53 is prepared by forming a rubber elastic layer 53*b* on a core metal 53*a* and then by coating a tube 53*c* of PFA resin on the elastic layer 53*b*. The pressing roller 53 is rotatably supported by side plates 59, provided at opposite end portions of the device frame 54 with respect to the X direction, at opposite end portions of the core metal 53*a* via bearings 60 (part (a) of FIG. 5). Incidentally, the side plates 59 are provided with guide slits 59*a* (part (a) of FIG. 5) extending along the Y direction which is a contact and separation direction.

[Pressing Unit]

The heating unit 52 is disposed, between the side plates 59, substantially parallel to the pressing roller 53 so as to oppose the pressing roller 53 on the heater 55 side. The portions-to-be-urged 58*b* of the respective flange members 58 provided at the opposite end portions of the heating unit 52 are slidably engaged with the guide slits 59*a*, formed on the side plates 59, along the Y direction. The portions-to-be-urged 58*b* slide on the guide slits 59*a*, so that the fixing film 51 contacts the pressing roller 53 and separates from the pressing roller 53.

To the respective flange members 58, at the portions-to-be-urged 58*a* thereof, predetermined pressure is applied in a direction toward the pressing roller 53 by a pressing mechanism 90 described later. By the pressure, an entirety of the heating unit 52 including the flange members 58, the stay 57, the guide 56 and the heater 55 is pressed in the direction toward the pressing roller 53. As a result, the guide 56 and the heater 55 are pressed against the pressing roller 53 via the fixing film 51 by the predetermined pressure against elasticity of the elastic layer 53*b*, so that the nip N having a predetermined width with respect to the Z direction is formed between the fixing film 51 and the pressing roller 53.

In this embodiment, the heater 55 and at least a part of the guide 56 depending on a pressed state are disposed so as to slide on an inner peripheral surface of the fixing film 51. Further, a portion sliding on the inner peripheral surface of the fixing film 51 functions as a sliding member (nip forming member) for forming the nip N while sandwiching the fixing film 51 between itself and the pressing roller 53.

[Fixing Operation]

Next, a fixing operation by the fixing device 50 will be described. To the core metal 53*a* of the pressing roller 53, a rotational driving force of the driving motor 13 with respect to a normal rotation direction is inputted through a drive transmission mechanism 70 described later. As a result, the pressing roller 53 is rotationally driven as a rotatably driving member at a predetermined peripheral speed in an arrow direction of FIG. 3. By rotational drive of the pressing roller 53, in the nip N, a rotational torque acts on the fixing film 51 by a frictional force between the fixing film 51 and the pressing roller 53. The fixing film 51 is rotated by rotation of the pressing roller 53.

Figure 3:
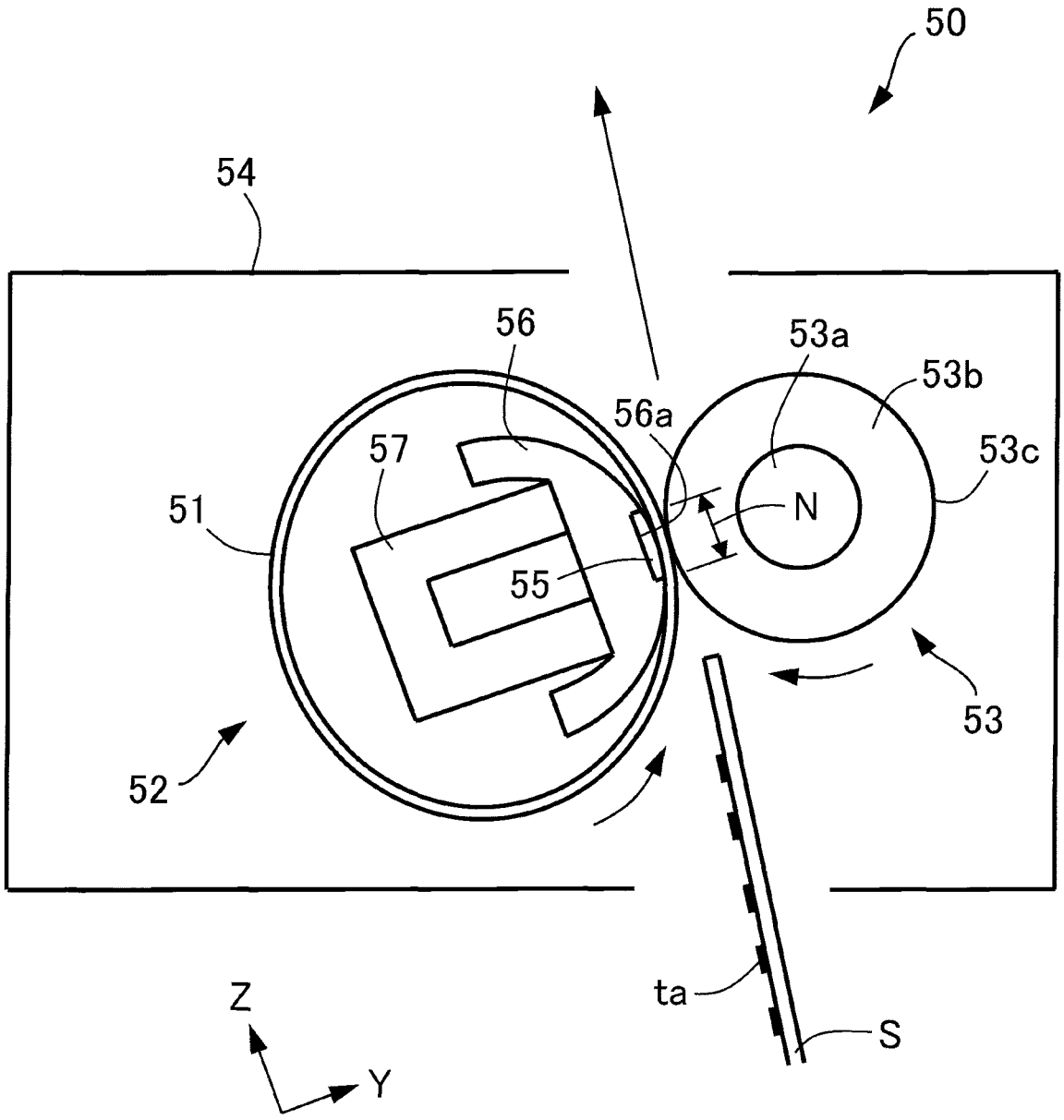
FIG. 3 is a sectional view showing a schematic structure of a fixing device according to the embodiment.
Figure 4:
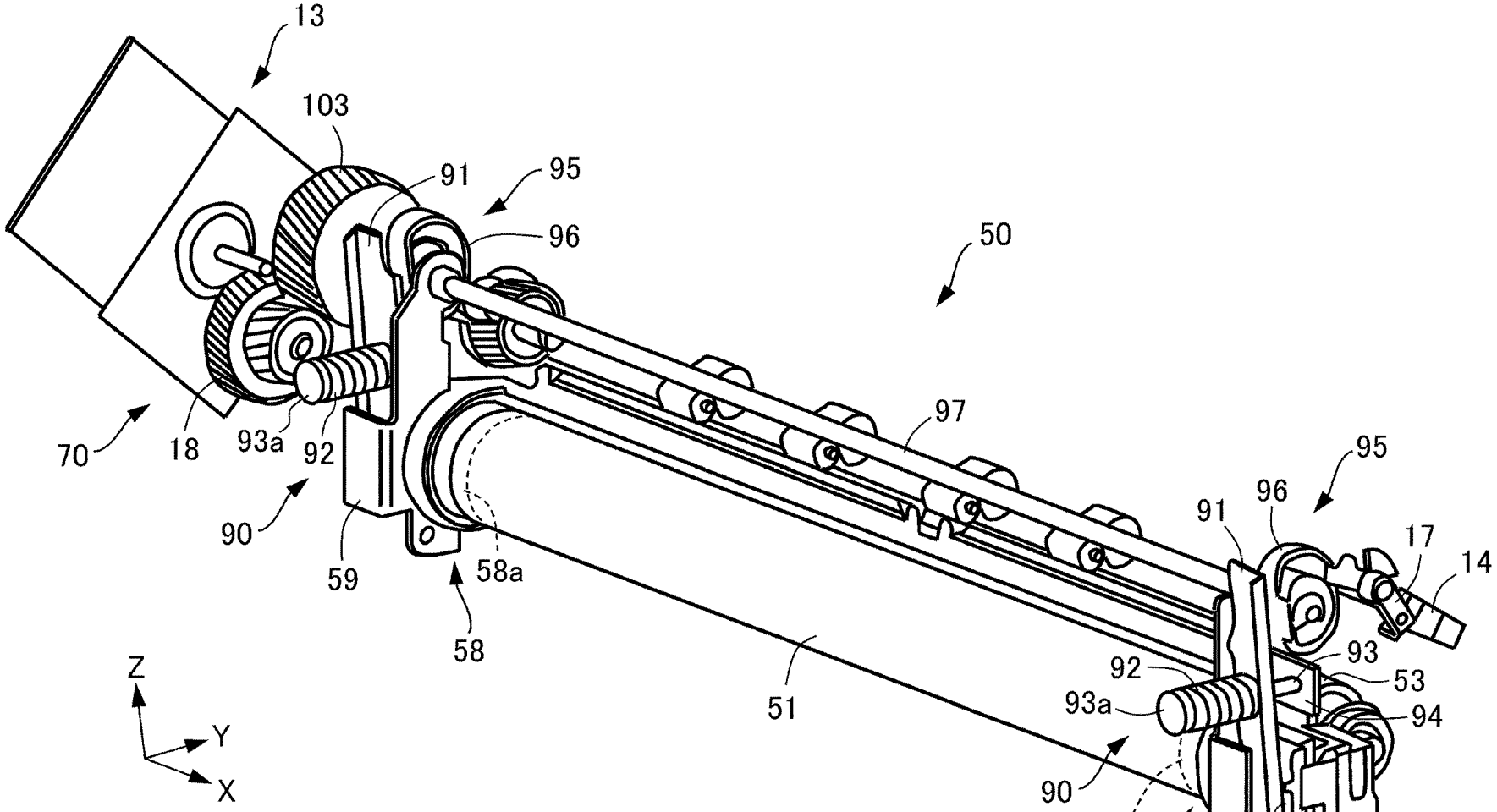
FIG. 4 is a perspective view showing the schematic structure of the fixing device according to the embodiment.

The fixing film 51 is rotated in an arrow direction of FIG. 3 on an outer peripheral surface side of the heater 55, the guide 56 and the stay 57 while intimately sliding (contacting) the heater 55 at the inner peripheral surface thereof in the nip N. A rotational speed (peripheral speed) of the fixing film 51 substantially corresponds to the rotational speed (peripheral speed) of the pressing roller 53. Onto the inner peripheral surface of the fixing film 51, grease as a lubricant is applied, so that a sliding property of the heater 55 and the guide 56 with the inner peripheral surface of the fixing film 51 is achieved.

The controller 16 starts energization from an unshown energizing portion to the heater 55. By this energization, the heater 55 is quickly increased in temperature, and a temperature of the heater 55 is detected by a thermistor 55*a* (FIG. 2) disposed in contact with the heater 55. On the basis of output from the thermistor 55*a*, the controller 16 controls electric power supplied to the heater 55 so that a heater temperature is increased to a target setting temperature (fixable temperature) and is controlled.

Into the fixing device 50 in which the heater 55 is temperature-controlled, the sheet S on which the unfixed toner image ta is formed is introduced from the image forming portion 40, and is nipped and fed through the nip N. To the sheet S, in a process in which the sheet S is nipped and fed through the nip N, heat of the heater 55 is imparted via the fixing film 51. As a result, the unfixed toner image ta is heated and pressed on the sheet S and thus is melt-fixed on the sheet S.

[Pressing Mechanism]

Outside the side plates 59 on opposite sides of the device frame 54, pressing mechanisms 90 are provided, respectively. The respective pressing mechanisms 90 have a symmetrical structure and the same structure, and therefore, a rear-side pressing mechanism 90 will be described as a representative example. A front-side pressing mechanism 90 is similar in structure to the rear-side pressing mechanism 90. Further, by the pressing mechanisms 90, a contact and separation mechanism capable of contacting and separating the fixing film 51 and the pressing roller 53 relative to each other is constituted.

As shown in parts (a) and (b) of FIG. 5, the pressing mechanism 90 includes an arm (pressing member) 91 and a gear spring (urging means) 92. The arm 91 is mounted on the side plate 59 on a base portion side thereof so as to be swingable about a shaft portion 91*a* as a center. The arm 91 is provided so as to extend from the shaft portion 91*a* and to pass through a side opposite from the pressing roller 53 with respect to the portion-to-be-urged 58*b* of the flange member 58. The arm 91 is capable of pressing the fixing film 51 and the pressing roller 53 in a press-contact direction in which the fixing film 51 and the pressing roller 53 are press-contacted to each other. The urging spring 92 comprises a compression coil spring for urging the arm 91 in the press-contact direction and urges the portion-to-be-urged 58*b* by rotating the arm 91 about the shaft portion 91*a* as a center in contact with the portion-to-be-urged 58*b* of the flange member 58.

In this embodiment, the arm 91 is provided with a through hole 91*b* on a side closer to a free end thereof than a portion contacting the portion-to-be-urged 58*b*. Into the through hole 91*b*, an adjusting screw 93 is inserted, so that a free end portion of the adjusting screw 93 is threadably engaged with a screw bore 94*a* of a screw receiving portion 94 fixed to the side plate 59. On a male screw portion between a head portion 93*a* of the adjusting screw 93 and the arm 91, the pressing spring 92 is externally engaged (fitted) and provided in a compression state. Accordingly, the arm 91 applies pressure to the flange member 58 in contact with the portion-to-be-urged 58*a* of the flange member 58 by a compression reaction force of the pressing spring 92 in a free state.

By fastening the adjusting screw 93, the head portion 93*a* of the adjusting screw 93 shortens a spring length of the pressing spring 92, so that a spring load extended on the arm 91 can be increased. The arm 91 is rotatably supported by the side plate 59, so that rotation moment generates around the shaft portion 91*a* by the compression reaction force of the pressing spring 92, so that the flange member 58 is pressed in a direction toward the pressing roller 53 by predetermined pressure. That is, the arm 91 is capable of being displaced between a first position and a second position. The first position is a position where for example, as shown in part (a) of FIG. 5, at least one of the pressing roller 53 and the fixing film 51 is pressed toward the other member so that the pressing roller 53 and the fixing film 51 form the nip N therebetween. The second position is a position where for example, as shown in part (b) of FIG. 5, the pressing roller 53 and the fixing film 51 are spaced (separated) from each other. Thus, the pressing spring 92 is urged against the arm 91 being in the first position, whereby at least one of the pressing roller 53 and the fixing film 51 is urged toward the other member.

Incidentally, in this embodiment, the second position, i.e., a pressure-released position of the arm 91 is the position where the pressing roller 53 and the fixing film 51 are spaced from each other, but is not limited thereto. For example, a position where the pressing roller 53 and the fixing film 51 are kept in contact with each other and a load acting on the nip N is smaller than that at the first position may also be used as the second position. In this case, the fixing film 51 is in a state in which the fixing film 51 lightly rides on the pressing roller 53.

[Pressure-Releasing Mechanism]

Release of the pressure by the pressing mechanism 90 is performed by the pressure-releasing mechanism 95. The pressure-releasing mechanism 95 includes pressure-releasing cams (second rotatable members) 96 for swinging the arm 91 of the pressing mechanism 90 and a cam shaft 97 connecting the pressure-releasing cams 96 provided on opposite sides of the cam shaft 97. The cam shaft 97 is rotatably shaft-supported by the side plate 59. The two pressure-releasing cams 96 provided on the opposite sides have the same shape such that a predetermined eccentricity amount is given, and are fixed at the same phase to the opposite end portions of the cam shaft 97, so that the pressure-releasing cams 96 are rotated integrally with the cam shaft 97. Each of the pressure-releasing cams 96 is positioned on a free end side of the arm 91 of the pressing mechanism 90.

To the cam shaft 97, a rotational driving force with respect to a reverse rotation direction of the driving motor 13 is inputted through the drive transmission mechanism 70 described later. By this drive transmission, the pressure-releasing cams 96 are rotation-controlled intermittently every 180° at predetermined timing between a rotational angle attitude shown in part (a) of FIG. 5 and a rotational angle attitude shown in part (b) of FIG. 5.

As shown in part (a) of FIG. 5, in a pressed state of the pressing mechanism 90, the pressure-releasing cam 96 of the pressure-releasing mechanism 95 assumes the rotational angle attitude such that a maximum projection portion 96*b* opposes and is in non-contact with the arm 91 of the pressing mechanism 90. At this time, each of the arms 91 is in a free state, so that the flange members 58 are pressed by the pressing springs 92 through the arms 91 of the pressing mechanisms 90. As a result, the fixing film 51 of the heating unit 52 and the pressing roller 53 are in press-contact with each other, and are held in a state (pressed state) in which the nip N having a predetermined width is formed therebetween.

As shown in part (b) of FIG. 5, in a pressure-released state of the pressing mechanism 90, the pressure-releasing cam 96 of the pressure-releasing mechanism 95 assumes the rotational angle attitude such that the maximum projection portion 96*b* opposes and contacts the arm 91 of the pressing mechanism 90. At this time, each of the arms 91 is pressed and swung against a spring force of the pressing spring 92 in a direction in which the arm 91 is spaced from the portion-to-be-urged 58*b* of the flange member 58. As a result, the fixing film 51 and the pressing roller 53 are in a state (pressure-released state) in which pressure therebetween is released. That is, the pressure-releasing cam 96 rotates by reverse rotation of the driving motor 13 and actuates the pressing mechanism 90 so that the fixing film 51 and the pressing roller 53 are spaced from each other. Thus, the arm being in the first position (part (a) of FIG. 5) is moved to the second position (part (b) of FIG. 5) by rotation of the pressure-releasing cam 96. Thus, the pressure-releasing cam 96 is a cam for moving the arm 91 being in the first position to the second position against the urging force of the pressing spring 92 by rotation of the input gear 103 in the reverse rotation direction. That is, during the reverse rotation of the driving motor 13, the pressure-releasing cam 96 is rotated so that the arm 91 is displaced against the pressing spring 92 in a direction opposite to a press-contact direction.

Incidentally, in this embodiment, the pressure is released until the fixing film 51 and the pressing roller 53 are spaced from each other (part (b) of FIG. 5). However, the pressure may also be only reduced without spacing the fixing film 51 and the pressing roller 53 when purposes that a removing operativity of a jammed sheet S is improved and that press-contact traces on the fixing film 51 and the pressing roller 53 are avoided can be achieved. For example, in the case where the constitution of this embodiment is employed, the above purposes can be achieved when a total pressure is reduced to about 20N by the pressure release.

In this embodiment, the pressure-released state includes a state in which the pressure is released until the fixing film 51 and the pressing roller 53 are spaced from each other and a state in which the pressure is reduced without spacing the fixing film 51 and the pressing roller 53 from each other. In the state in which the pressure is reduced to a predetermined magnitude, the pressing mechanism 90 can be displaced between a first state in which the nip N is formed and a second state in which a force exerted on the fixing film 51 and the pressing roller 53 by the pressing mechanism 90 is smaller than the force when the pressing mechanism 90 is in the first state. Further, the pressure-releasing mechanism 95 displaces the pressing mechanism 90 from the first state to the second state.

[Drive Transmission Mechanism]

As shown in FIG. 6, the controller 16 controls the driving motor 13 so as to rotate normally during image formation. By normally rotating the driving motor 13, the rotational driving force is transmitted to the pressing roller 53 via a drive train of the drive transmission mechanism 70. On the other hand, in the case where an unshown jam detection sensor detects a jam of the sheet S, as shown in FIG. 7, the controller 16 controls the driving motor so as to rotate reversely. When the driving motor 13 rotates reversely, the pressure-releasing cams 96 are rotated, so that the fixing film 51 and the pressing roller 53 are spaced from each other. Rotation of a pressure-releasing flag 17 is detected by a spacing sensor 14, and the driving motor 13 is stopped and thus a spacing operation is completed. That is, the spacing sensor 14 is capable of detecting that the pressure-releasing cams 96 displace the arms 91 in a direction opposite to the press-contact direction and space (separate) the fixing film 51 and the pressing roller 53 from each other. Irrespective of rotational directions of the respective rotatable elements, those when the driving motor 13 rotates in the normal rotation direction are referred to as a normal rotation direction, and those when the driving motor 13 rotates in the reverse rotation direction are referred to as a reverse rotation direction.

The drive transmission mechanism 70 includes a driving gear 18 provided in the apparatus main assembly 10 and includes a first clutch unit 101 and a second clutch unit 102 which are provided in the fixing device 50. The first clutch unit 101 is a unidirectional clutch unit during normal rotation for establishing drive transmission when the pressing roller 53 is driven during normal rotation of the driving motor 13. The second clutch unit 102 is a unidirectional clutch unit during reverse rotation for establishing drive transmission when the pressing roller 53 is driven during reverse rotation of the driving motor 13. Incidentally, as shown in FIG. 6, the fixing device 50 is provided with the first clutch unit 101, the pressing roller 53, the second clutch unit 102, the pressure-releasing cams 96, the pressure-releasing flag 17 and the spacing sensor 14. Further, the apparatus main assembly 10 is provided with the driving motor 13 and the driving gear 18. That is, the clutch units 101 and 102 for switching drive input when the driving motor 13 is rotated normally and reversely are provided in the fixing device 50. It becomes possible to identify a site of a malfunction by detecting drive transmission on upstream sides of the clutch units 101 and 102 with respect to a drive transmission direction in the fixing device 50 when the driving motor 13 rotates normally.

The second clutch unit 102 includes the input gear 103 engaged with the driving gear 18 and provided coaxially with the pressure-releasing cam 96 and includes a clutch (second disconnecting means) 104 provided coaxially with the input gear 103 and the pressure-releasing cam 96. The clutch 104 is a unidirectional clutch which transmits the driving force from the input gear 103 to the pressure-releasing cam 96 during the reverse rotation of the driving motor 13 shown in FIG. 7 and which does not transmit the driving force from the input gear 103 to the pressure-releasing cam 96 during the normal rotation of the driving motor 13 shown in FIG. 6.

The first clutch unit 101 includes an input gear 105 engaged with the input gear 103, an output gear 107 engaged with a gear portion of the pressing roller 53, and a clutch (first disconnecting means) 106 provided coaxially between the input gear 105 and the output gear 107. As shown in parts (a) and (b) of FIG. 8, on the clutch 106 side of the input gear 105, an engaging projection 105*a* for rotating the clutch 106 in engagement with the clutch 106 with respect to a circumferential direction even either of during the normal rotation and during the reverse rotation of the driving motor 13 (FIG. 6 and FIG. 7) is provided. On the input gear 105 side of the clutch 106, an engaging groove 106*a* with which the engaging projection 105*a* is engaged is formed in a longer shape than the engaging projection 105*a* with respect to the circumferential direction. In the engaging groove 106*a*, at a portion on a side where the engaging projection 105*a* is engaged during the normal rotation of the driving motor 13, a guiding surface 106*a* for guiding the engaging projection 105*a* in a direction in which the clutch 106 is separated from the input gear 105 in an axial direction.

On the other hand, ratchet teeth 106*c* and 107*a* opposing each other with respect to the axial direction are provided on the output gear 107 side of the clutch 106 and the clutch 106 side of the output gear 107, respectively. These ratchet teeth 106*c* and 107*a* are formed in a direction in which these teeth engage with each other during the normal rotation of the driving motor 13 (FIG. 6) and idle each other during the reverse rotation of the driving motor 13 (FIG. 7).

Accordingly, the clutch 106 is a unidirectional clutch operating in the following manner. That is, as shown in part (a) of FIG. 9, the clutch 106 transmits the driving force from the input gear 105 to the output gear 107 by being moved from the input gear 105 toward the output gear 107 in the axial direction during the normal rotation of the driving motor 13 (FIG. 6). Further, as shown in part (b) of FIG. 9, the clutch 106 does not transmit the driving force from the input gear 105 to the output gear 107 by being moved from the output gear 107 toward the input gear 105 in the axial direction during the reverse rotation of the driving motor 13 (FIG. 7). Incidentally, in this embodiment, the clutch 104 also has the same constitution and is similarly operated. Further, in this embodiment, the clutches 106 and 104 have the above-described constitution and are operated as described above, but are not limited thereto, and as these clutches, known or new appropriate unidirectional clutches can be used.

Here, a transmission path, provided in the apparatus main assembly 10 and including the driving motor 13, for transmitting the rotational force from the driving motor 13 to the input gear 103 is a transmission path on the main assembly side. Further, a transmission path, provided in the fixing device 50, for transmitting the rotational driving force from the driving motor 13, from the input gear 103 to the pressing roller 53 during the normal rotation in which the input gear 103 rotates in the normal rotation direction, is a first transmission path. Further, a transmission path, provided in the fixing device 50, for transmitting the rotational driving force from the driving motor 13, from the input gear 103 to the pressure-releasing cam 96 during the reverse rotation in which the input gear 103 rotates in the reverse rotation direction, is a second transmission path.

Accordingly, the driving motor 13 and the driving gear 18 which transmit the rotational driving force to the input gear 103 form the transmission path on the main assembly side. The input gear 103, the input gear 105, the clutch 106 and the output gear 107 which transmit the driving force to the pressing roller 53 inside the fixing device 50 during the normal rotation of the driving motor 13 form the first transmission path. The pressing roller 53 is provided rotatably in the fixing device 50, and is rotatable by transmission of the rotational driving force from the driving motor 13 via the transmission path on the main assembly side and the first transmission path in the fixing device 50 during the normal rotation of the driving motor 13. Further, the input gear 103 and the clutch 104 which transmit the driving force to the pressure-releasing cam 96 inside the fixing device 50 pressing the reverse rotation of the driving motor 13 form the second transmission path. The pressure-releasing cam 96 is rotatable by transmission of the rotational driving force from the driving motor 13 via the transmission path on the main assembly side and the second transmission path in the fixing device 50 during the reverse rotation of the driving motor 13.

The clutch 106 is interposed in the first transmission path, connects the first transmission path during the normal rotation in which the input gear 103 rotates in the normal rotation direction, and disconnects the first transmission path during the reverse rotation in which the input gear 103 rotates in the reverse rotation direction. The clutch 104 is interposed in the second transmission path, disconnects the second transmission path during the normal rotation in which the input gear 103 rotates in the normal rotation direction, and connects the second transmission path during the reverse rotation in which the input gear 103 rotates in the reverse rotation direction.

As shown in FIG. 6 and part (a) of FIG. 10, in the case where the driving motor 13 rotates normally, the driving force rotationally drives the pressing roller 53 via the driving gear 18 and the first clutch unit 101. On the other hand, the driving force with respect to the normal rotation direction is cut off by the second clutch unit 102, so that the pressure-releasing cam 96 disposed coaxially with the second clutch unit 102 is in a non-rotational state. For that reason, as shown in part (a) of FIG. 5, a maximum projection portion 96*b* of the pressure-releasing cam 96 is not displaced relative to a rotation center of the cam shaft 97, so that the fixing film 51 and the pressing roller 53 maintain a pressed state in which the fixing film 51 and the pressing roller 53 are pressed by the pressing spring 92.

As shown in FIG. 7 and part (b) of FIG. 10, in the case where the driving motor 13 rotates reversely, the driving force is cut off by the first clutch unit 101 and is not transmitted to the pressing roller 53, so that the pressing roller 53 is in a rotation stop state. On the other hand, the driving force with respect to the reverse rotation direction is transmitted to the pressure-releasing cam 96 by the second clutch unit 102. As a result, as shown in part (b) of FIG. 5, the pressure-releasing cam 96 is rotated and a maximum projection portion 96*b* of the pressure-releasing cam 96 is displaced relative to a rotation center of the cam shaft 97. Then, the arm 91 supporting the fixing film 51 is rotated against the urging force of the pressing spring 92, so that the fixing film 51 and the pressing roller 53 are in a pressure-released state.

[Spacing Sensor]

Next, detection of spacing (separation) between the fixing film 51 and the pressing roller 53 with use of the spacing sensor (rotation detecting means) 14 will be described. As shown in FIG. 4, the pressure-releasing flag 17 swings in interrelation with rotation of the pressure-releasing cam 96. The spacing sensor 14 comprises, for example, a photosensor and is provided so as to be capable of detecting passing of the pressure-releasing flag 17, i.e., rotation of the pressure-releasing cam 96. As a result, it becomes possible to determine a stop position of the pressure-releasing flag 17, and by extension to the pressure-releasing cam 96.

For example, in the case where an unshown jam detection sensor detects a jam of the sheet S, the controller 16 controls the driving motor 13 so as to be rotated reversely. When the spacing sensor 14 detects the pressure-releasing flag 17, the controller 16 stops the reverse rotation of the driving motor 13 after rotation of the driving motor 13 by a predetermined pulse number. That is, in the case where the jam of the sheet S occurs in the nip N, on the basis of an output of the spacing sensor 14, the controller 16 causes the arm 91 being in the first position to move to the second position. Further, during the occurrence of the jam of the sheet S, the controller 16 causes the driving motor 13 to be rotated reversely, and stops the driving motor 13 when the fixing film 51 and the pressing roller 53 are spaced from each other. In the case where jam clearance is completed and the sheet S jammed in the nip N of the fixing device 50 is not detected by the unshown jam detection sensor, the controller 16 causes the driving motor 13 to be rotated reversely by the predetermined pulse number after the spacing sensor 14 does not detect the pressure-releasing flag 17. By further rotation of the pressure-releasing cam 96 in the reverse rotation direction by the driving motor 13, the maximum projection portion 96*b* is displaced toward a side opposite from the arm 91, so that the arm 91 is pressed by the pressing spring 92 and is restored to the pressed state. Incidentally, a rotation time of the driving motor 13 during the reverse rotation is a time in which the pressure-releasing cam 96 rotates one turn or more. As a result, the pressure-releasing cam 96 can be detected with reliability.

Incidentally, as described above, a constitution in which the pressure is released by the reverse rotation of the driving motor 13 with use of the spacing sensor 14 is not limited to application to the fixing device of an ODF (on-demand fuser) type. For example, even to a fixing device of a POD (print on-demand) type in which pressure is applied so as to exert a load by a cam, the above-described constitution is applicable by using a rotation (position) detection sensor of the cam.

Thus, by controlling the normal rotation direction and the reverse rotation direction of the driving motor 13, it is possible to not only rotate the pressing roller 53 by a single motor 13 during the image formation but also space the fixing film 51 and the pressing roller 53 from each other by transmitting the driving force to the pressure-releasing cam 96 during jam detection. For this reason, operativity during jam clearance can be improved compared with an increase in door opening and closing force by pressure release with use of a door and a lever release by a user.

Next, a process procedure in the case where a drive error which is abnormality on drive from the driving motor 13 to the pressing roller 53 occurs will be described along a flowchart shown in FIG. 11. This process is automatically performed by the controller 16 in the case where the drive error occurred.

When an image forming job is inputted to the controller 16 (step S1), the controller 16 starts image formation by normally rotating the driving motor 13 (step S2). That is, during the image formation, the controller 16 causes the driving motor 13 to rotate normally, so that the pressing roller 53 is rotated. During the image formation, the controller 16 discriminates whether or not the drive error is detected (step S3). The drive error in this case includes many errors, such as malfunctions of the driving motor 13 and a drive circuit substrate, breakage of the gear and the like of the drive transmission mechanism 70, an overload of the pressing roller 53 and the like, but in this embodiment, abnormalities of the driving motor 13 and the drive circuit substrate are detected. That is, the controller 16 as an abnormality detecting means detects the abnormality on drive from the driving motor 13 to the pressing roller 53, and particularly detects abnormality on the driving motor 13. Specifically, in the case where a feed-back value in PWM control is an abnormal value, the controller 16 discriminates that some abnormality on the driving motor 13 or the drive circuit substrate occurs. That is, a specific example of the abnormality is abnormality relating to improper rotation including not only presence or absence of rotation but also abnormality on a number of rotations (turns) and is, for example, a malfunction and loss of synchronism of the driving motor 13, and a state in which the drive (driving force) of the driving motor 13 cannot be transmitted to the pressing roller 53. In the case where the controller 16 discriminated that the drive error is not detected during the image forming process (NO of step S3), the controller 16 causes the driving motor 13 to rotate normally (step S2) and continues the image forming process.

Incidentally, in this embodiment, the case where the controller 16 as the abnormality detecting means detects the abnormality on the drive from the driving motor 13 to the pressing roller 53 and particularly detects the abnormality of the driving motor 13 is described, but the present invention is not limited thereto. The abnormality detecting means is not limited thereto, but a sensor capable of detecting another drive error may also be applicable thereto. That is, as a constitution for detecting the abnormality of the driving motor, not only another sensor can be used, but also a sensor for detecting the abnormality may also be provided at a portion other than the driving motor. For example, in the case where the driving motor is a stepping motor, a sensor such as an encoder for detecting loss of synchronism of the driving motor may also be utilized.

During the image forming process, in the case where the controller 16 discriminated that the drive error is detected (YES of step S3), the controller 16 causes the driving motor 13 to rotate reversely (step S4). That is, in the case where the abnormality on the drive is detected when the driving motor 13 is rotated in a direction in which the input gear 103 is rotated in the normal rotation direction, the controller 16 carries out a mode in which the driving motor 13 is rotated in a direction in which the input gear 103 is rotated in the reverse rotation direction.

The controller 16 discriminates whether or not the spacing sensor 14 detects the pressure-releasing flag 17 (step S5). As a result, the controller 16 checks whether or not the drive is transmitted to the second transmission path during the reverse rotation of the driving motor 13. Here, in the check as to whether or not the drive is transmitted to the second transmission path during the reverse rotation of the driving motor 13, the spacing sensor 14 is utilized, so that there is no need to provide a new sensor. Incidentally, a rotational speed of the driving motor 13 during the reverse rotation may preferably be made slower than a rotational speed of the driving motor 13 during the normal rotation. As a result, an occurrence of a reading error of the spacing sensor 14 can be suppressed.

In the case where the controller 16 discriminated that the spacing sensor 14 detects the pressure-releasing flag 17 (YES of step S5), discrimination that the driving force was transmitted from the driving motor 13 to the pressure-releasing flag 17 is made. That is, it is possible to check that no abnormality occurs in a drive train from the driving motor 13 to the pressure-releasing flag 17. Accordingly, discrimination that the drive error occurred in the first clutch unit 101 or the pressing roller 53, i.e., in the fixing device 50, can be made (step S6). Then, the controller 16 causes a touch panel 12*a* to display a message to the effect that the drive error in the fixing device 50 occurs (step S7). Thus, in the case where the controller 16 causes the driving motor 13 to rotate reversely when the drive error occurs during the normal rotation of the driving motor 13 and where the pressure-releasing flag 17 rotates, information on the message to the effect that the drive error occurs in the fixing device 50 is outputted from the touch panel 12*a*. That is, in the case where rotation of the pressure-releasing cam 96 is detected by the spacing sensor 14 in the operation in the mode, the controller 16 outputs the information indicating that the abnormality occurred in the fixing device 50. As an example of the information indicating that the abnormality occurred in the fixing device 50, for example, an error number corresponding to this information may also be outputted. Or, for example, the information may also be information indicating that the drive error occurred in the first transmission path between the input gear 103 and the pressing roller 53.

On the other hand, in the case where the controller 16 discriminated that the spacing sensor 14 does not detect the pressure-releasing flag 17 (NO of step S5), discrimination that the driving force was not transmitted from the driving motor 13 to the pressure-releasing flag 17 is made. In this case, it would be considered that abnormality of the driving gear 18 or the driving motor 13 in the apparatus main assembly 10 occurs or abnormality of the second clutch unit 102, the pressure-releasing cam 96 or the pressure-releasing flag 17 occurs. Accordingly, discrimination that the drive error occurred in a part of the fixing device 50 or the apparatus main assembly 10 can be made (step S8). Then, the controller 16 causes a touch panel 12*a* to display a message to the effect that the drive error in the part of the fixing device 50 or the apparatus main assembly 10 occurs (step S7). Thus, the controller 16 causes the driving motor 13 to rotate reversely when the drive error occurs during the normal rotation of the driving motor 13. Then, in the case where the pressure-releasing flag 17 does not rotate, information on the message to the effect that the drive error occurs in a drive path (transmission path) in the apparatus main assembly 10 and a region including a drive path (transmission path) in the fixing device 50 is outputted from the touch panel 12*a* by the controller 16. That is, in the case where rotation of the pressure-releasing cam 96 is not detected by the spacing sensor 14 in the operation in the mode, the controller 16 outputs the information indicating that the abnormality occurred in the transmission path on the main assembly side and the region including the transmission path in the fixing device 50. As an example of the information indicating that the abnormality occurred in the fixing device 50, for example, an error number corresponding to this information may also be outputted. Or, for example, information indicating that the drive error occurred in the transmission path between the driving motor 13 and the pressure-releasing cam 96 may be outputted.

That is, in the case where the rotation of the pressure-releasing cam 96 is not detected by the spacing sensor 14 in the operation in the mode, the controller 16 outputs information indicating that the abnormality occurred in the transmission path on the main assembly side and the region including the fixing device 50. As a specific example of the information indicating that the drive error in this case occurred in the drive path (transmission path) and the region including the drive path (transmission path) in the fixing device 50, for example, an error number corresponding to this information may also be outputted. Or, for example, information indicating that the drive error occurred in a transmission path between the driving motor 13 and the pressure-releasing cam 96 may also be outputted.

From the above, in the case where the spacing sensor 14 cannot detect the pressure-releasing flag 17 in the step S5, discrimination as to whether the abnormality is the abnormality of the fixing device 50 or the abnormality of the apparatus main assembly 10 becomes partially insufficient. However, even in the case where the spacing sensor 14 cannot detect the pressure-releasing flag 17 in the step S5, it is possible to narrow a range to whether the abnormality is the abnormality of the apparatus main assembly 10 or the abnormality of the second clutch unit 102, the pressure-releasing cam 96 or the pressure-releasing flag 17 in the fixing device 50. For this reason, compared with the case where the range is not narrowed, it is possible to reduce a time in which a service person can identify a site of a malfunction.

Incidentally, in order to completely discriminate whether the abnormality is caused by the fixing device 50 or is caused by the apparatus main assembly 10, there is a need to use a sensor for detecting rotation and teeth shape of the driving gear 18 and the input gear 103 of the second clutch unit 102. However, for that purpose, a displacement sensor is needed, so that there is a liability that a cost relating to the image forming apparatus itself increases.

As described above, according to the image forming apparatus 1 of this embodiment, the controller 16 causes the driving motor 13 to rotate reversely in the case where the drive error occurred during the normal rotation of the driving motor 13. Then, in the case where the pressure-releasing cam 96 rotates, the controller 16 causes the touch panel 12*a* to display the message to the effect that the drive error occurred in the fixing device 50. Further, in the case where the pressure-releasing cam 96 does not rotate, the controller 16 causes the touch panel 12*a* to display the message to the effect that the drive error occurred in the part of the fixing device 50 or in the apparatus main assembly 10. As a result, in the case where the drive error occurs from the driving motor 13 of the apparatus main assembly 10 to the pressing roller 53 of the fixing device 50, it is possible to discriminate whether the site of the malfunction is the region including the apparatus main assembly 10 or is the fixing device 50. That is, by reversely rotating the driving motor 13 during the occurrence of the malfunction, it is possible to easily identify the site where the malfunction occurred, by a relatively small number of component parts and a simple constitution. For this reason, it is possible to reduce an operation time of the service person and downtime of the user.

In the image forming apparatus 1 of this embodiment described above, the case where the unidirectional clutch is used as each of the first disconnecting means and the second disconnecting means was described, but the present invention is not limited thereto. As the first disconnecting means and the second disconnecting means, for example, a swingable gear, a one-way planetary gear, an electromagnetic clutch and the like may also be used.

Further, in the image forming apparatus 1 of the above-described embodiment, the case where the second rotatable member is the pressure-releasing cam 96 was described, but the present invention is not limited thereto, and the second rotatable member may only be required to be a member which is provided on a side downstream of the disconnecting means in the drive train in the fixing device 50 with respect to a drive transmission direction. For example, in the case where a transmission member such as a gear is provided between the clutch 104 and the pressure-releasing cam 96, the transmission member may also be used as the second rotatable member. Or, for example, in the case where an inner discharging roller or the like is provided in the drive transmission path from the driving motor 13 to the pressing roller 53, the inner discharging roller may also be used as the second rotatable member. Incidentally, the second rotatable member is not limited to the roller of an inner discharge type.

Further, in the image forming apparatus 1 of the above-described embodiment, the case where the pressing roller 53 is used as the first rotatable member which is directly driven by the driving motor 13 during the normal rotation of the driving motor 13 was described, but the present invention is not limited thereto, and the fixing film 51 may also be used as the first rotatable member.

Further, in the image forming apparatus 1 of the above-described embodiment, the constitution in which the driving motor 13 is reversely rotated in response to the detection of the drive error during the normal rotation of the driving motor 13 was described as an example, but the driving motor 13 may also be normally rotated in response to detection of the drive error during the reverse rotation of the driving motor 13. That is, in the case where the rotation of the pressure-releasing cam 96 cannot be detected by the spacing sensor 14, the driving motor 13 is normally rotated. When the drive transmission can be detected in the drive path (transmission path) from the driving motor 13 to the pressing roller 53, the drive (driving force) is transmitted from the driving motor 13 to the input gear 103. For this reason, the drive error occurred in the second transmission path between the input gear 103 and the pressure-releasing cam 96. Accordingly, the controller 16 outputs the information on the message to the effect that the drive error occurred in the fixing device 50. On the other hand, in the case where the drive transmission cannot be detected in the drive path from the driving motor 13 to the pressing roller 53, it can be discriminated that the drive error occurred in the part of the fixing device 50 or in the apparatus main assembly 10. Accordingly, the controller 16 outputs the information on the message to the effect that the drive error occurred in the drive path in the apparatus main assembly 10 and in the region including the drive path in the fixing device 50.

Further, in the image forming apparatus 1 of the above-described embodiment, the first rotatable member and the second rotatable member were applied to the fixing device 50, but the present invention is not limited thereto. For example, the present invention is applicable to various purposes such as a constitution in which rotation and pull-in of a toner bottle are switched by normal rotation and reverse rotation of a motor in terms of a rotational direction, a site (portion) where a roller for feeding the sheet S is selectively rotated, rotational drive of a developing device of a rotary type, and the like.

Further, in the image forming apparatus 1 of the above-described embodiment, the case where the first clutch unit 101 and the second clutch unit 102 were used for switching the drive was described, but the present invention is not limited thereto. That is, in the above-described embodiment, the clutch 106 is used as the first disconnecting means and the clutch 104 is used as the second disconnecting means, but the first disconnecting means and the second disconnecting means are not limited to these clutches 106 and 104. For example, as the first disconnecting means and the second disconnecting means, a constitution using a pendulum gear and a pendulum supporting gear may also be applied. In this case, as shown in FIGS. 12 and 13, a pendulum supporting gear 108 and a pendulum gear (input gear) 109 are used for switching of the driving force between the pressure-releasing cam 96 and the output gear 106. For example, the pendulum supporting gear 108 engaging with the driving gear 18 is provided in the apparatus main assembly 10. Further, the pendulum gear 109 engages with not only the pendulum supporting gear 108, but also the pressure-releasing cam 96 and the output gear 107 by swinging a center shaft depending on the rotational direction of the pendulum supporting gear 108.

As shown in FIG. 12, during normal rotation of the driving motor 13, the pendulum gear 109 is swung toward the output gear 107 side by rotation of the pendulum supporting gear 108 and engages with the output gear 107, so that drive transmission to the pressing roller 53 can be performed. At this time, the pendulum gear 109 functions as the first disconnecting means not only connecting the first transmission path but also disconnecting the second transmission path when the input gear 103 is rotated in the normal rotation direction. Further, as shown in FIG. 13, during the reverse rotation of the driving motor 13, the pendulum gear 109 is swung toward the pressure-releasing cam 96 by rotation of the pendulum supporting gear 108 and engages with the pressure-releasing cam 96, so that drive transmission to the pressure-releasing cam 96 can be performed. At this time, the pendulum gear 109 functions as the second disconnecting means not only disconnecting the first transmission path but also connecting the second transmission path when the input gear 103 is rotated in the reverse rotation direction. Thus, also in the case where the pendulum supporting gear 108 and the pendulum gear 109 are used, when the drive error occurred in the driving system from the driving motor 13 of the apparatus main assembly 10 to the pressing roller 53, it is possible to discriminate whether the site of the malfunction is the region including the apparatus main assembly 10 or the fixing device 50.

Further, in the image forming apparatus 1 of the above-described embodiment, the case where the controller 16 executes the operation in the mode when the abnormality is detected and causes the touch panel 12*a* to display the predetermined information on the basis of the detection result of the spacing sensor 14 was described, but the present invention is not limited thereto. For example, in the case where the rotation of the pressure-releasing cam 96 is not detected by the spacing sensor 14 when the driving motor 13 is reversely rotated, the operation in the mode in which the driving motor 13 is normally rotated may also be executed. In this case, in the case where the abnormality on the drive is detected in the operation in the mode, the controller 16 causes the touch panel 12*a* to output the information indicating that the abnormality on the drive transmission by the driving motor 13 occurred in the transmission path on the main assembly side and the region including the fixing device 50. Further, in the case where the abnormality on the drive is not detected in the operation in the mode, the controller 16 causes the touch panel 12*a* to output the information indicating that the abnormality on the drive transmission by the driving motor 13 occurred in the fixing device 50. Also in this case, in the case where the drive error occurred in the driving system from the driving motor 13 of the apparatus main assembly 10 to the pressing roller 53 of the fixing device 50, it is possible to discriminate whether the site of the malfunction is the region including the apparatus main assembly 10 or the fixing device 50.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-145438 filed on Aug. 1, 2018, which is hereby incorporated by reference herein in its entirety.

What is claimed is:

1. An image forming apparatus for forming a toner image on a recording material, comprising:

a motor provided in said image forming apparatus and rotatable in a first direction and a second direction opposite to the first direction;

a unit which includes a first rotatable member and a second rotatable member and which is mountable to and dismountable from a main assembly of said image forming apparatus;

an input gear provided in said unit and configured to permit input of a driving force of said motor from said image forming apparatus;

a first transmission path provided in said unit, wherein when said motor rotates in the first direction, the driving force is transmitted from said input gear to said first rotatable member and is not transmitted from said input gear to said second rotatable member;

a second transmission path provided in said unit, wherein when said motor rotates in the second direction, the driving force is transmitted from said input gear to said second rotatable member and is not transmitted from said input gear to said first rotatable member;

a rotation detecting portion capable of detecting rotation of said second rotatable member; and a controller configured to execute an operation in an abnormality output mode for outputting abnormality information, wherein if said first rotatable member is not rotated despite rotation of said motor in the first direction, said controller inputs a signal for rotating said motor in the second direction, and (1) if said second rotatable member is not rotated, said controller outputs abnormality information on said motor or a drive transmission path for transmitting the driving force from said motor to said input gear, and (2) if said second rotatable member is rotated, said controller outputs abnormality information on said unit.

2. An image forming apparatus according to claim 1, wherein said unit includes:

first disconnecting means provided in said first transmission path and configured so that said input gear is connected to said first transmission path when said motor rotates in the first direction and so that said first transmission path is disconnected when said motor rotates in the second direction, and second disconnecting means provided in said second transmission path and configured so that said second transmission path is disconnected when said motor rotates in the first direction and so that said second transmission path is connected when said motor rotates in the second direction, and wherein the abnormality information on said unit is information indicating that abnormality occurs in said unit.

3. An image forming apparatus according to claim 1, further comprising a rotation detecting member configured to detect the rotation of said first rotatable member.

4. An image forming apparatus according to claim 1, wherein said first rotatable member forms a nip for heating the image on the recording material, wherein said unit includes a third rotatable member configured to form the nip in cooperation with said first rotatable member and includes a pressing member capable of being displaced between a first position where at least one of said first rotatable member and said third rotatable member is pressed toward the other rotatable member and a second position where said first rotatable member and said third rotatable member are spaced from each other, and wherein said pressing member in the first position is moved to the second position by rotation of said third rotatable member.

5. An image forming apparatus according to claim 4, wherein said unit includes urging means configured to urge at least one of said first rotatable member and said third rotatable member toward the other rotatable member by urging said pressing member in the first position, and wherein said second rotatable member is a cam configured to move said pressing member in the first position to the second position against an urging force of said urging means by rotation of said input gear in the second direction.

6. An image forming apparatus according to claim 4, wherein when a jam of the recording material occurs in the nip, said rotatable member in the first position moves to the second position.

7. An image forming apparatus according to claim 1, further comprising a display portion configured to display the abnormality information.

* * * * *